US011710905B1

(12) United States Patent
Booen et al.

(10) Patent No.: US 11,710,905 B1
(45) Date of Patent: Jul. 25, 2023

(54) SURFACE ERROR REDUCTION FOR A CONTINUOUS ANTENNA REFLECTOR

(71) Applicant: Meta Platforms, Inc., Menlo Park, CA (US)

(72) Inventors: Eric Booen, Thousand Oaks, CA (US); Wilhelmus Hendrikus Theunissen, Oxnard, CA (US)

(73) Assignee: Meta Platforms, Inc., Menlo Park, CA (US)

( * ) Notice: Subject to any disclaimer, the term of this patent is extended or adjusted under 35 U.S.C. 154(b) by 512 days.

(21) Appl. No.: 16/686,957

(22) Filed: Nov. 18, 2019

(51) Int. Cl.

| | |
|---|---|
| ***H01Q 15/14*** | (2006.01) |
| ***H01Q 19/19*** | (2006.01) |
| ***H01Q 15/16*** | (2006.01) |
| ***H01Q 1/28*** | (2006.01) |

(52) U.S. Cl.
CPC ..... *H01Q 15/147* (2013.01); *H01Q 1/288* (2013.01); *H01Q 15/16* (2013.01); *H01Q 19/19* (2013.01)

(58) Field of Classification Search
CPC ..... H01Q 1/288; H01Q 15/147; H01Q 15/148; H01Q 15/16; H01Q 15/165; H01Q 15/166; H01Q 15/168; H01Q 19/19
See application file for complete search history.

(56) References Cited

U.S. PATENT DOCUMENTS

| | | | |
|---|---|---|---|
| 9,337,544 | B2 | 5/2016 | Theunissen et al. |
| 2014/0191925 | A1* | 7/2014 | Theunissen et al. . H01Q 15/147 343/912 |

OTHER PUBLICATIONS

Fang et al., "High-Precision Adaptive Control of Large Reflector Surface", 2008, pp. 1-6.
IM et al., "Prospects of Large Deployable Reflector Antennas for a New Generation of Geostationary Doppler Weather Radar Satellites", AIAA SPACE Conference & Exposition, Sep. 2007, pp. 1-11.
Lacasse, Richard J., "The Green Bank Telescope Active Surface System", GBT Memo 184, SPIE, Vol. 3351, May 1998, pp. 310-319.
Orbit, "AL-4018S Single Drive El/Az Positioner", 2015, 2 pages.
Tongying et al., "Reflector adjustment for a large radio telescope based on active optics", Software and Cyberinfrastructure for Astronomy II, Proc. of SPIE, Vol. 8451, 2012, 7 pages.
Wang et al., "Active Surface Compensation for Large Radio Telescope Antennas", International Journal of Antennas and Propagation, Vol. 2018, Article ID: 3903412, Mar. 29, 2018, pp. 1-17.
Woddy et al., "Panel options for large precision radio telescopes", Advanced Optical and Mechanical Technologies in Telescopes and Instrumentation, Proc. of SPIE 7018, 2008, 12 pages.

* cited by examiner

*Primary Examiner* — Robert Karacsony
(74) *Attorney, Agent, or Firm* — Greenberg Traurig, LLP

(57) ABSTRACT

The disclosed method may include (1) determining a current physical state regarding an antenna assembly that includes (a) a sub-reflector that receives a wireless signal and reflects the wireless signal to a feed structure for processing, (b) a continuous antenna reflector that receives the wireless signal at a reflecting surface that reflects the wireless signal to the sub-reflector, where the current physical state is indicative of a current surface error over the reflecting surface relative to the sub-reflector, and (c) a backing structure coupled to a back surface of the continuous antenna reflector opposite the reflecting surface and having a plurality of actuators distributed over, and coupled to, the back surface, (2) operating each of the plurality actuators in a manner that reduces the current surface error based on the current physical state. Various other methods and systems are also disclosed.

18 Claims, 22 Drawing Sheets

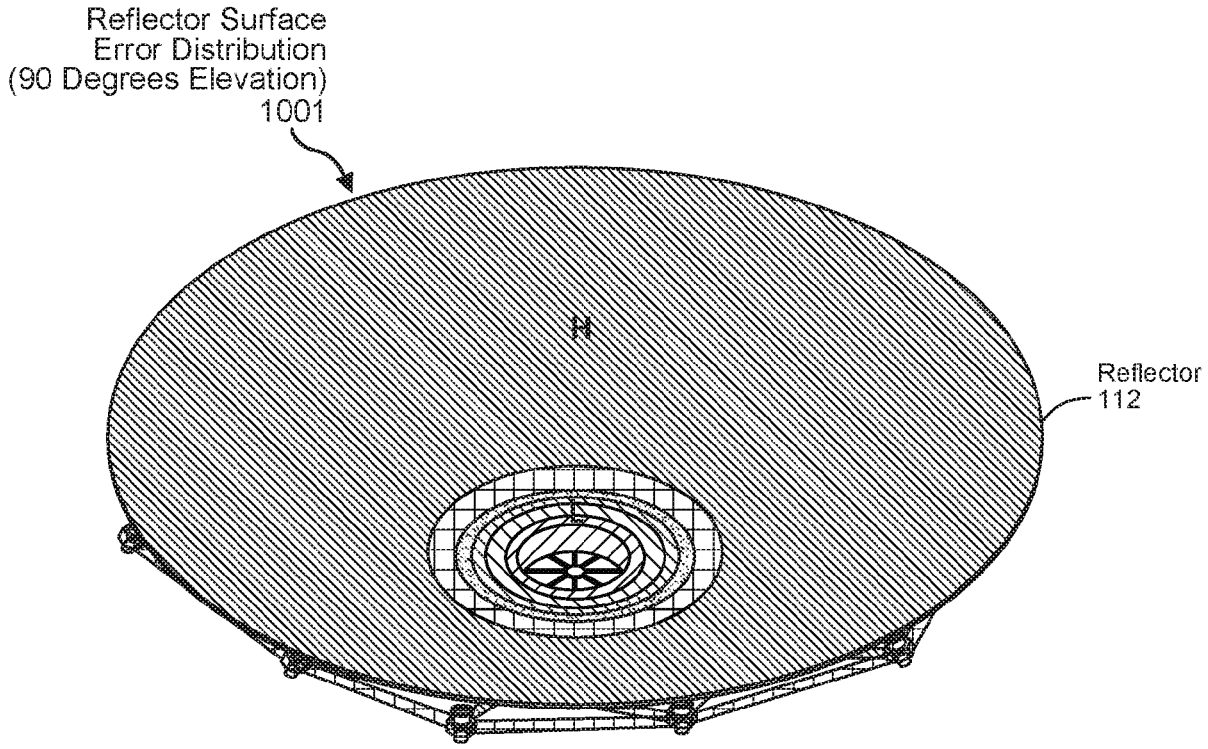
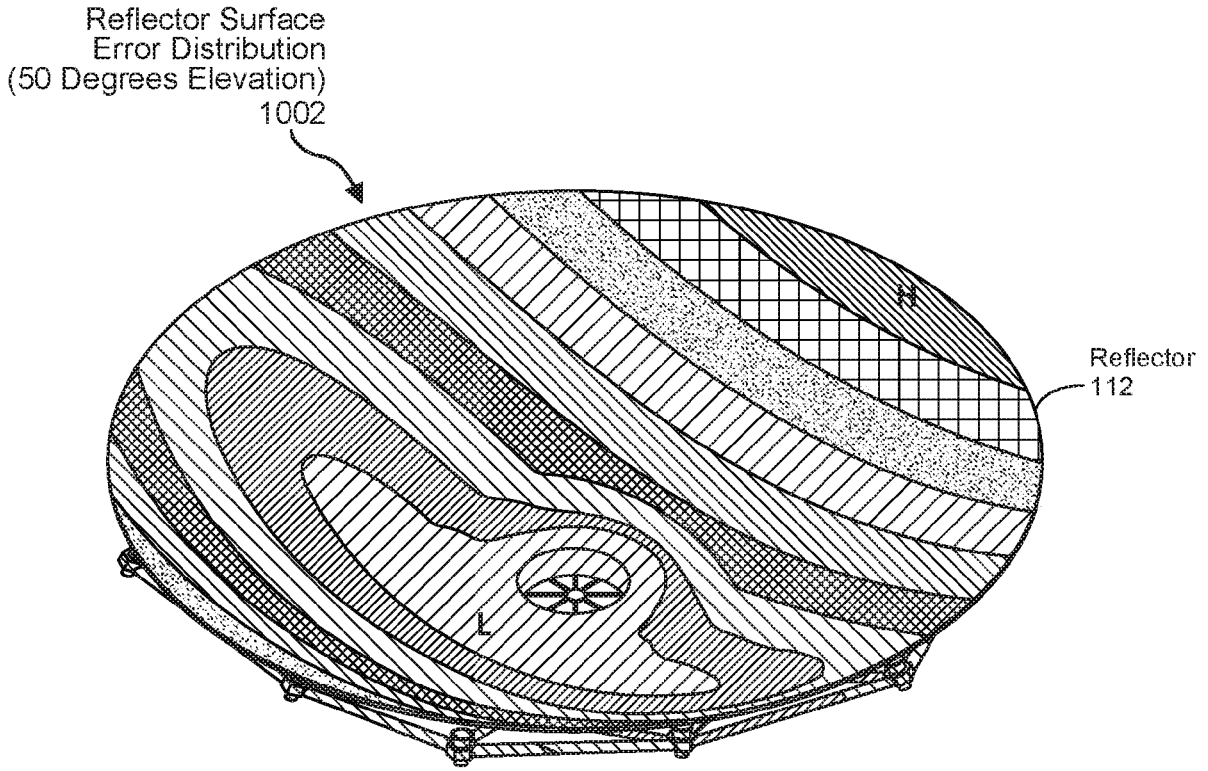
FIG. 10A

Surface Error Correction Lookup Table 1300

Elevation Angle 1304

Actuator Number 1302

| | Act. 1 | Act. 2 | Act. 3 | Act. 4 | ... | Act. 17 | Act. 18 |
|---|---|---|---|---|---|---|---|
| 0° | Act. Pos. (in) | Act. Pos. (in) | Act. Pos. (in) | Act. Pos. (in) | ... | Act. Pos. (in) | Act. Pos. (in) |
| 1° | Act. Pos. (in) | Act. Pos. (in) | Act. Pos. (in) | Act. Pos. (in) | ... | Act. Pos. (in) | Act. Pos. (in) |
| 2° | Act. Pos. (in) | Act. Pos. (in) | Act. Pos. (in) | Act. Pos. (in) | ... | Act. Pos. (in) | Act. Pos. (in) |
| 3° | Act. Pos. (in) | Act. Pos. (in) | Act. Pos. (in) | Act. Pos. (in) | ... | Act. Pos. (in) | Act. Pos. (in) |
| 4° | Act. Pos. (in) | Act. Pos. (in) | Act. Pos. (in) | Act. Pos. (in) | ... | Act. Pos. (in) | Act. Pos. (in) |
| 5° | Act. Pos. (in) | Act. Pos. (in) | Act. Pos. (in) | Act. Pos. (in) | ... | Act. Pos. (in) | Act. Pos. (in) |
| 6° | Act. Pos. (in) | Act. Pos. (in) | Act. Pos. (in) | Act. Pos. (in) | ... | Act. Pos. (in) | Act. Pos. (in) |
| ... | ... | ... | ... | ... | ... | ... | ... |
| 87° | Act. Pos. (in) | Act. Pos. (in) | Act. Pos. (in) | Act. Pos. (in) | ... | Act. Pos. (in) | Act. Pos. (in) |
| 88° | Act. Pos. (in) | Act. Pos. (in) | Act. Pos. (in) | Act. Pos. (in) | ... | Act. Pos. (in) | Act. Pos. (in) |
| 89° | Act. Pos. (in) | Act. Pos. (in) | Act. Pos. (in) | Act. Pos. (in) | ... | Act. Pos. (in) | Act. Pos. (in) |
| 90° | Act. Pos. (in) | Act. Pos. (in) | Act. Pos. (in) | Act. Pos. (in) | ... | Act. Pos. (in) | Act. Pos. (in) |

*FIG. 13*

SURFACE ERROR REDUCTION FOR A CONTINUOUS ANTENNA REFLECTOR

BRIEF DESCRIPTION OF THE DRAWINGS

The accompanying drawings illustrate a number of exemplary embodiments and are a part of the specification. Together with the following description, these drawings demonstrate and explain various principles of the present disclosure.

FIGS. 10A and 10B include perspective views of the reflector of FIG. 3 in which a surface error distribution of the reflector at three different elevation angles is displayed graphically.

FIG. 13 is a block diagram of an exemplary lookup table including a desired actuator position of each actuator for each of a number of elevation angles of the antenna reflector to reduce surface error.

Figure 1:
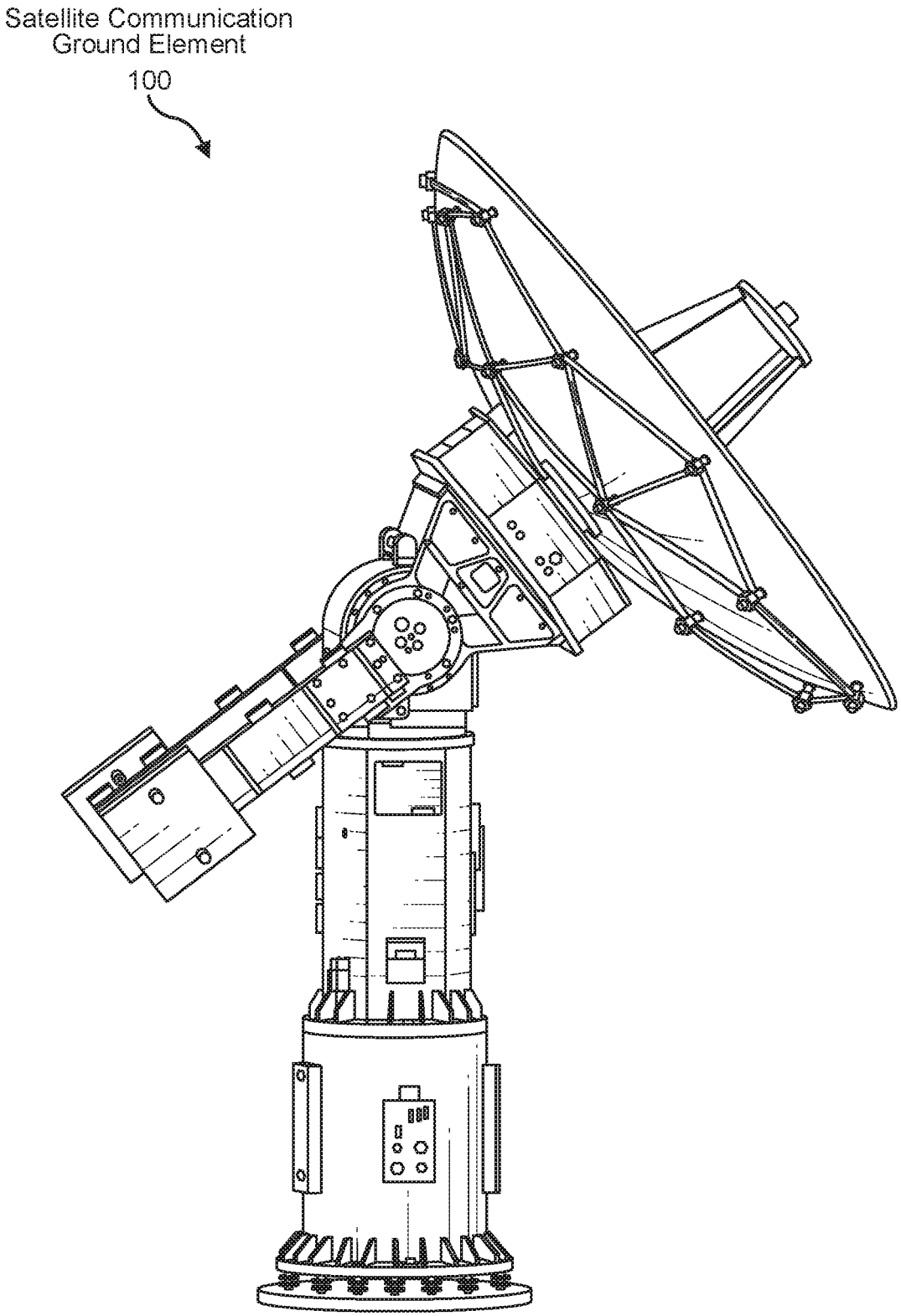
FIG. 1 is an assembled perspective view of an exemplary satellite communication ground element that may employ various systems and methods of surface error reduction discussed herein.

Throughout the drawings, identical reference characters and descriptions indicate similar, but not necessarily identical, elements. While the exemplary embodiments described herein are susceptible to various modifications and alternative forms, specific embodiments have been shown by way of example in the drawings and will be described in detail herein. However, the exemplary embodiments described herein are not intended to be limited to the particular forms disclosed. Rather, the present disclosure covers all modifications, equivalents, and alternatives falling within the scope of the appended claims.

DETAILED DESCRIPTION OF EXEMPLARY EMBODIMENTS

As demand for higher data rates in communication system links continues substantially unabated, newer such links are developed to support correspondingly higher communication frequencies. In those links that communicatively couple two points wirelessly, such as links between a satellite and a ground station employing a reflective antenna (e.g., a radio frequency (RF) antenna employing a parabolic reflector), the precision of the shape of the reflecting surface of the antenna is of significant importance for aperture efficiency during transmission and reception of such signals, especially at high frequencies (and, thus, shorter wavelengths, such as in the millimeter range).

More specifically, in many such wireless communication links, a link budget may be established that substantially dictates several aspects of the link, such as the size of an antenna aperture (or width) at each end of the link, the precision with which each antenna may be oriented at each end, and the transmission or reception efficiency of that aperture. In at least some orbiting communication systems, the size of the aperture at an orbiting end of the link may be limited due to a relative lack of resources (e.g., power, payload size, etc.) of the orbiting vehicle. To compensate, a ground-based end of the link may possess a larger aperture, resulting in a larger reflecting surface for the antenna. In conjunction with this larger surface, the mass of the reflector may be limited so that the size and power of the associated positioner used to orient the reflecting surface to follow the orbiting vehicle to maintain the link may remain reasonable. This combination of increased size and limited mass of the antenna reflector may increase the inaccuracy of the surface (e.g., the surface error) of the reflector due to the effects of gravity and other forces on the reflector, thus reducing the performance of the link. Additionally, the surface error of the reflector may change depending on the orientation of the reflector.

The present disclosure is generally directed to surface error reduction of a continuous antenna reflector. As will be explained in greater detail below, embodiments of the present disclosure may include a backing structure for an antenna reflector that includes a plurality of actuators, each of which may exert a force at a corresponding location of the reflector to reduce the surface error of the reflector, which may increase the performance of the associated antenna, potentially resulting in fewer data transmission errors.

Features from any of the embodiments described herein may be used in combination with one another in accordance with the general principles described herein. These and other embodiments, features, and advantages will be more fully understood upon reading the following detailed description in conjunction with the accompanying drawings and claims.

The following will provide, with reference to FIGS. 1-19, detailed descriptions of various systems and embodiments for surface error reduction of a continuous antenna reflector. A description of an exemplary satellite communication ground element and its various constituents, including an exemplary reflector and associated backing structure, are described in conjunction with the perspective views of FIGS. 1-3. In reference to the block diagram of FIG. 4, an exemplary system including the constituents of the satellite communication ground element is discussed. A description of the backing structure, as well as a plurality of actuators included therein, is described in connection with FIGS. 5 and 6. A discussion of an influence function associated with each of three different sets of actuators of the backing structure is presented in conjunction with FIGS. 7-9. A discussion of the surface error of the reflector related to the elevation angle of the reflector (e.g., when tracking an orbiting satellite) is discussed in association with the perspective views of FIGS. 10A and 10B. A description of the use of the actuators (e.g., by way of their influence functions) to reduce the surface error of the reflector over a range of elevation angles for the reflector is provided in association with FIGS. 11, 12A, 12B, and 12C. Further, with respect to FIG. 13, an exemplary lookup table holding data relating the actuator (e.g., stroke) position of each actuator to each of a plurality of elevation angles is discussed. The possible use of sensors that sense a current physical state of the reflector in the dynamic adjustment of the actuators to reduce the reflector surface error is explained in connection with FIG. 14. Various methods of employing the backing structure to reduce the reflector surface error, as described earlier in the specification, are then discussed with respect to the flow diagrams of FIGS. 15-18, while an exemplary system that employs at least one physical processor and a memory containing instructions to perform the various operations described earlier are discussed in connection with the block diagram of FIG. 19.

Figure 2:
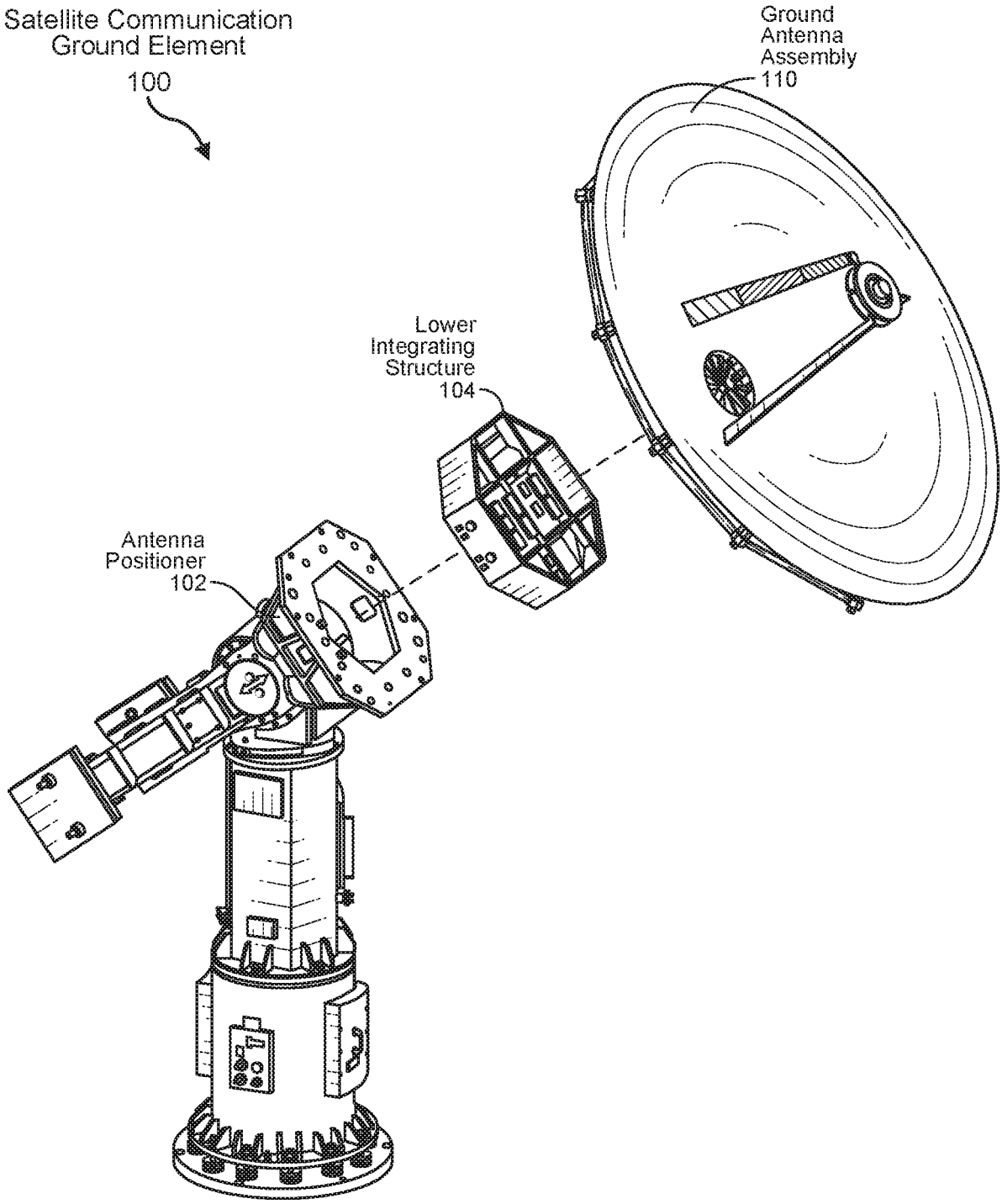
FIG. 2 is an exploded perspective view of the satellite communication ground element of FIG. 1, including an exemplary ground antenna assembly.

FIGS. 1 and 2 are perspective assembled and perspective exploded views, respectively, of a satellite communication ground element 100 to which various embodiments for surface error reduction, as described below, may be incorporated. While the examples provided below presume use of the embodiments within the environment of satellite communication ground element 100, other communication systems employing a signal-reflecting component may benefit from the various embodiments disclosed hereinafter. As shown more explicitly in FIG. 2, satellite communication ground element 100 may include an antenna positioner 102, a lower integrating structure 104, and a ground antenna assembly 110 that includes a reflecting surface for receiving and/or transmitting wireless signals. In some examples, satellite ground communication element 100 provides one end of a wireless (e.g., RF) communication link in communication with an orbiting (e.g., low Earth orbit (LEO)) satellite.

Antenna positioner 102 may orient ground antenna assembly 110 and lower integrating structure 104, both of which may be affixed to antenna positioner 102, to track a satellite over time so that ground antenna assembly 110 may receive wireless signals from the satellite and/or transmit signals to the satellite. In some embodiments, antenna positioner 102 may be have two rotation stages: an azimuth stage that provides a yaw rotation to rotate ground antenna assembly 110 left and right, and an elevation stage that imparts a pitch rotation to rotate ground antenna assembly 110 up and down. In some examples, antenna positioner 102, as shown in FIGS. 1 and 2, may represent an elevation-over-azimuth design, in which the elevation stage resides atop the azimuth stage. However, other configurations for antenna positioner 102 are also possible. Further, antenna positioner 102, in some embodiments, may receive commands or signals from a tracking system external or internal to satellite communication ground element 100 to perform the orientation operations for ground antenna assembly 110.

Lower integrating structure 104, in some embodiments, may mechanically couple ground antenna assembly 110 to antenna positioner 102 while also providing circuitry employed to process communication signals received from ground antenna assembly 110, as well as process signals for transmission via ground antenna assembly 110. Functions performed by such circuitry may include, but are not limited to, filtering, frequency conversion, amplification, and so on. Lower integrating structure may also include one or more feedhorns or other feed structures that channel signals between the circuitry of lower integrating structure 104 and ground antenna assembly 110.

Figure 3:
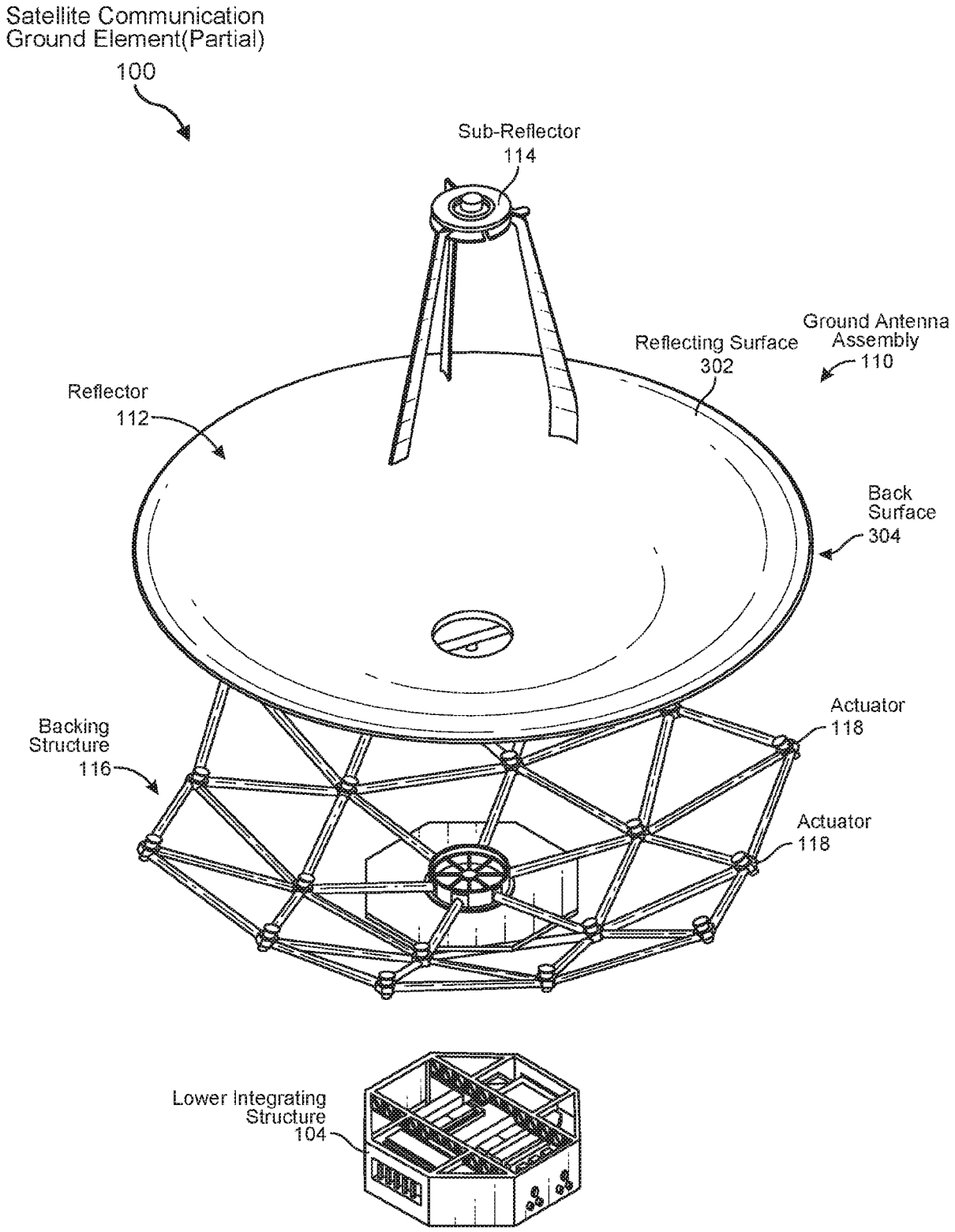
FIG. 3 is an exploded perspective partial view of the satellite communication ground element of FIG. 1, including several portions of the ground antenna assembly of FIG. 2, including a reflector and an associated backing structure.

FIG. 3 provides a perspective exploded partial view of satellite communication ground element 100 showing ground antenna assembly 110 in conjunction with lower integrating structure 104. As shown, ground antenna assembly 110 may include a reflector 112 (e.g., a parabolic reflector) that includes a reflecting surface 302 and a back surface 304 opposite reflecting surface 302, a sub-reflector 114, and a backing structure 116. Further, backing structure 116 may include a plurality of actuators 118 that may apply force upon back surface 304 of reflector 112 to modify a shape of reflecting surface 302 to reduce its surface error, as is discussed in greater detail below.

During wireless signal reception, reflector 112 may be receive a wireless RF signal from an orbiting satellite and reflect that signal to sub-reflector 114 (e.g., by way of the parabolic shape of reflecting surface 302), which may, in turn, reflect the wireless signal through a central opening in reflector 112 to one or more feedhorns and receiver circuitry in lower integrating structure 104. In the case of signal transmission, the signal path may be reversed, from circuitry and feedhorns in lower integrating structure 104, to sub-reflector 114, to reflector 112, to the orbiting satellite.

In some examples, reflector 112 may be relatively large (e.g., 2.4 meters (m) in diameter) compared to other satellite ground-based antennas (e.g., direct broadcast satellite (DBS) ground-based antennas) to compensate for a relatively small aperture (e.g., via a 50-centimeter (cm) antenna) employed on the orbiting satellite. To maintain a reasonable weight for reflector 112 to facilitate support and movement via antenna positioner 102, reflector 112 may be a continuous (e.g., single-piece) reflector constructed of a firm, lightweight material (e.g., a carbon fiber laminate molded over a graphite tool). While such a material may provide excellent structural firmness, small perturbations in reflecting surface 302 that alter the distance between reflecting surface 302 and sub-reflector 114 at various points on reflecting surface 302 may adversely affect the wireless signal as received or transmitted by satellite communication ground element 100. Moreover, in some examples, as discussed below, the elevation angle at which ground antenna assembly 110 is oriented may alter the surface error of reflecting surface 302 due the changing angle of the gravitational force vector relative to reflector 112, thus rendering a one-time static correction of the surface error of reflector surface 302 substantially ineffective. In one example, in which reflector 112 may be designed to operate in the 72-84 gigahertz (GHz) signal range, a 0.003-inch maximum root-mean-square (RMS) surface deviation or error for reflecting surface 302 may be desired, regardless of elevation angle of reflector 112.

To reduce the surface error, actuators 118 may be distributed about backing structure 116, and thus about back surface 304 of reflector 112. In the embodiments described below, actuators 118 are presumed to be linear actuators. However, other types of actuators that may impart a force onto back surface 304 may be employed in other examples. Also, in some embodiments, by setting the stroke positions of each of actuators 118 to an appropriate position, the surface error at most or all locations on reflecting surface 302 may be reduced sufficiently to significantly increase the fidelity of received and transmitted signals being relayed by reflecting surface 114. In some examples, an acting surface of each actuator 118 may be affixed (e.g., via adhesive, screws, and so on) to back surface 304 to facilitate applying a force normal to back surface 304 either toward or away from back surface 304. In yet other examples, actuators 118 may not be affixed to back surface 304, thus allowing force to be applied only in a single direction (e.g., toward back surface 304).

Figure 4:
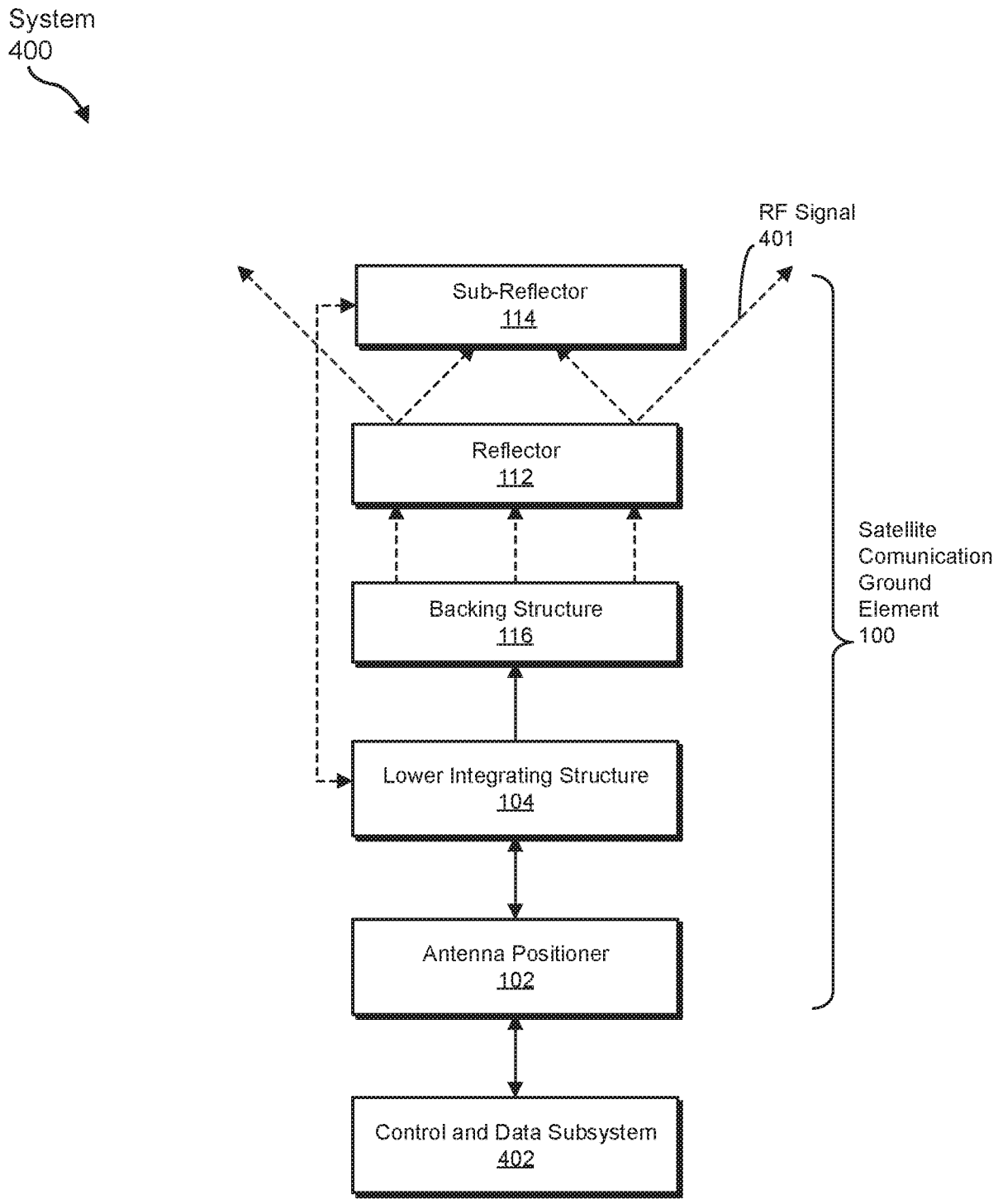
FIG. 4 is a block diagram of an exemplary system including the satellite communication ground element of FIG. 1 that may include surface error reduction functionality.

FIG. 4 is a block diagram of a system 400 depicting the various components of satellite communication ground element 100 in conjunction with a control and data subsystem 402. More specifically, reflector 112 and sub-reflector 114 relay transmitted and/or received RF signals 401 between the orbiting satellite and lower integrating structure 104, as shown above. Further, lower integrating structure 104 may communicate with backing structure 116 (e.g., to provide signals commands for operating actuators 118), thus causing actuators 118 to apply one or more forces to reflector 112 (e.g., via back surface 304) to reduce the current surface error of reflecting surface 302. Further, antenna positioner 102 may physically orient backing structure 116, reflector 112, and sub-reflector 114 (e.g., via lower integrating structure 104). In addition, antenna position 102 may relay data regarding the positioning (e.g., azimuth and elevation data) it receives to lower integrating structure 104, which may employ that data to operate actuators 118 of backing structure 116. Such data, in some examples, may originate from a control and data subsystem 402 communicatively coupled to antenna positioner 102, where control and data subsystem 402 may generate and/or provide the elevation and azimuth data to track one or more orbiting satellites, as well as provide communication data to be transmitted, and accept communication data received, via satellite communication ground element 100. In other examples, some of the data provided and/or received by control and data subsystem 402 may be provided directly to lower integrating structure 104 and/or backing structure 116, thereby circumventing antenna positioner 102.

Figure 5:
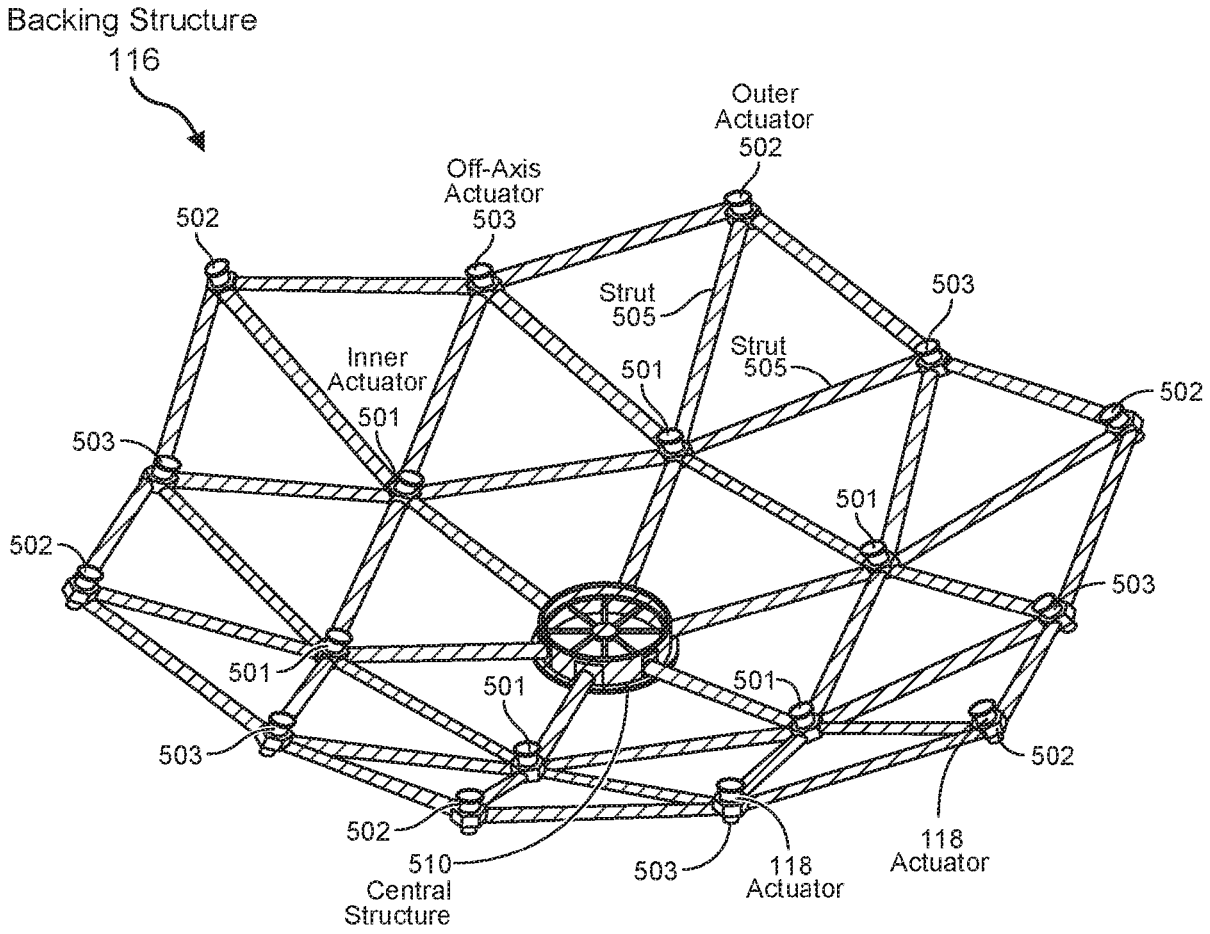
FIG. 5 is a perspective view of an exemplary backing structure of the ground antenna assembly of FIGS. 2 and 3 including a plurality of actuators that may provide surface error reduction for a reflector of the ground antenna assembly.

FIG. 5 is a perspective view of backing structure 116 in some embodiments. As depicted, backing structure 116 may include a central structure 510 that couples directly with a central portion of reflector 112 (e.g., at back surface 304). In addition, in some examples, emanating from central structure 510 may be a plurality of struts 505 (e.g., linear elements) that are mechanically coupled to actuators 118 to form a network or grid by which actuators 118 may apply force to back surface 304 at a plurality of points distributed thereabout. In the embodiment of FIG. 5, struts 505 and actuators 118 may form adjacent equilateral triangles that substantially align with back surface 304, thus forming an overall quasi-parabolic, quasi-isogrid structure. Consequently, each actuator 118 may be directly coupled or affixed to an end of three, four, or six separate struts 505. Further, in such an embodiment, each strut 505 may be the same length or substantially so. In the particular embodiment of FIG. 5, eighteen actuators 118 are employed in backing structure 116. However, greater or fewer numbers of actuators 118 may be used in other embodiments depending on a number of factors, such as the tolerable level of surface error exhibited by reflector 112, the level of flexibility possessed by reflector 112, the diameter of reflector 112, and the like.

Given the pattern of actuators 118 provided by backing structure 116 of FIG. 5, actuators 118 may be conceptually partitioned into three groups based on their location within the structure: inner actuators 501, outer actuators 502, and off-axis actuators 503. More specifically, the six inner actuators 501 may be distributed equidistantly about a central structure 510 at a particular radius from a center of backing structure 116, with each inner actuator 501 being connected to an end of six separate struts 505. Distributed equidistantly at a larger radius from the center of backing structure 116 may be six outer actuators 502, each of which may be radially connected to a corresponding inner actuator 501 via a single strut 505 and directly connected to the ends of three separate struts 505. At a radial distance between inner actuators 501 and outer actuators 502 may be six off-axis actuators 503, each of which may be directly connected via two struts 505 to separate inner actuators 501 and two addition struts 505 to separate outer actuators 502. The term "off-axis" in this case is utilized to convey the notion that off-axis actuators 503 are not aligned radially with inner actuators 501 and outer actuators 502.

Figure 6:
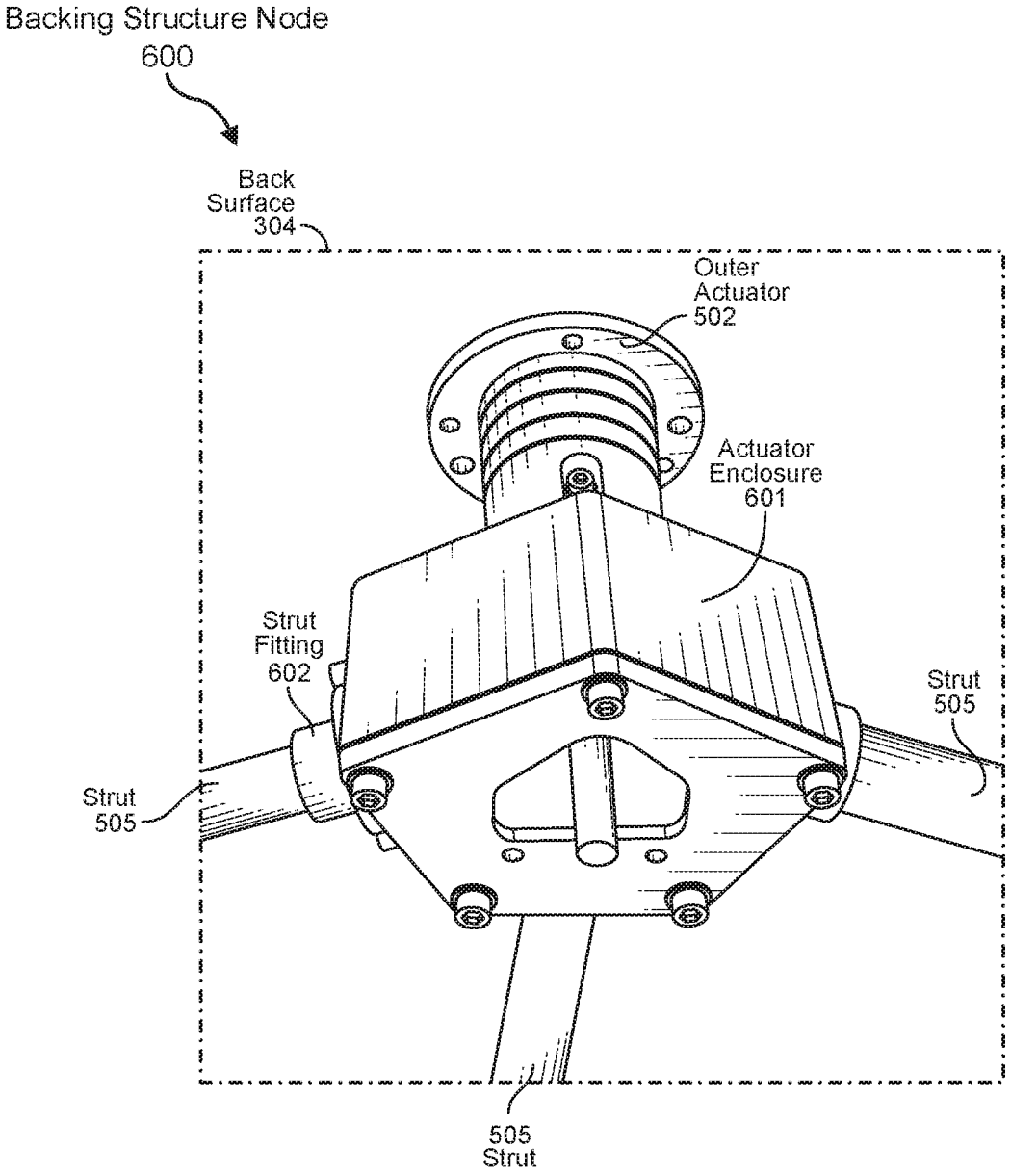
FIG. 6 is a perspective view of an exemplary backing structure node including an actuator for providing surface error correction.

FIG. 6 is a perspective view of an exemplary backing structure node 600 that includes an actuator 118 (specifically, an outer actuator 502) within an actuator enclosure 601. In some examples, actuator enclosure 601 may include a number of sides that are angled in a manner that allows connection of each end of each strut 505 to be affixed perpendicularly to actuator enclosure 601 (e.g., by way of corresponding strut fittings 602, which may be shaped as flanges or the like). Thus, in some examples, side surfaces of actuator enclosure 601 may be angled inward from a base toward a top of actuator enclosure 601 to align an acting surface of actuator 118 substantially parallel to the portion of back surface 304 with which outer actuator 502 makes contact. As mentioned above, the acting surface of each actuator 118 may be affixed to a corresponding portion of back surface 114 via adhesive, fasteners (e.g., screws), the like. In some examples, since actuators 118 of each actuator group (e.g., inner actuators 501, outer actuators 502, and off-axis actuators 503) may be directly connected to a different number of struts 505, actuator enclosure 601 may be shaped differently for each group of actuators 118. Additionally, each actuator 118 may be a linear actuator, although other types of actuators 118 are possible in other embodiments.

Figure 7:
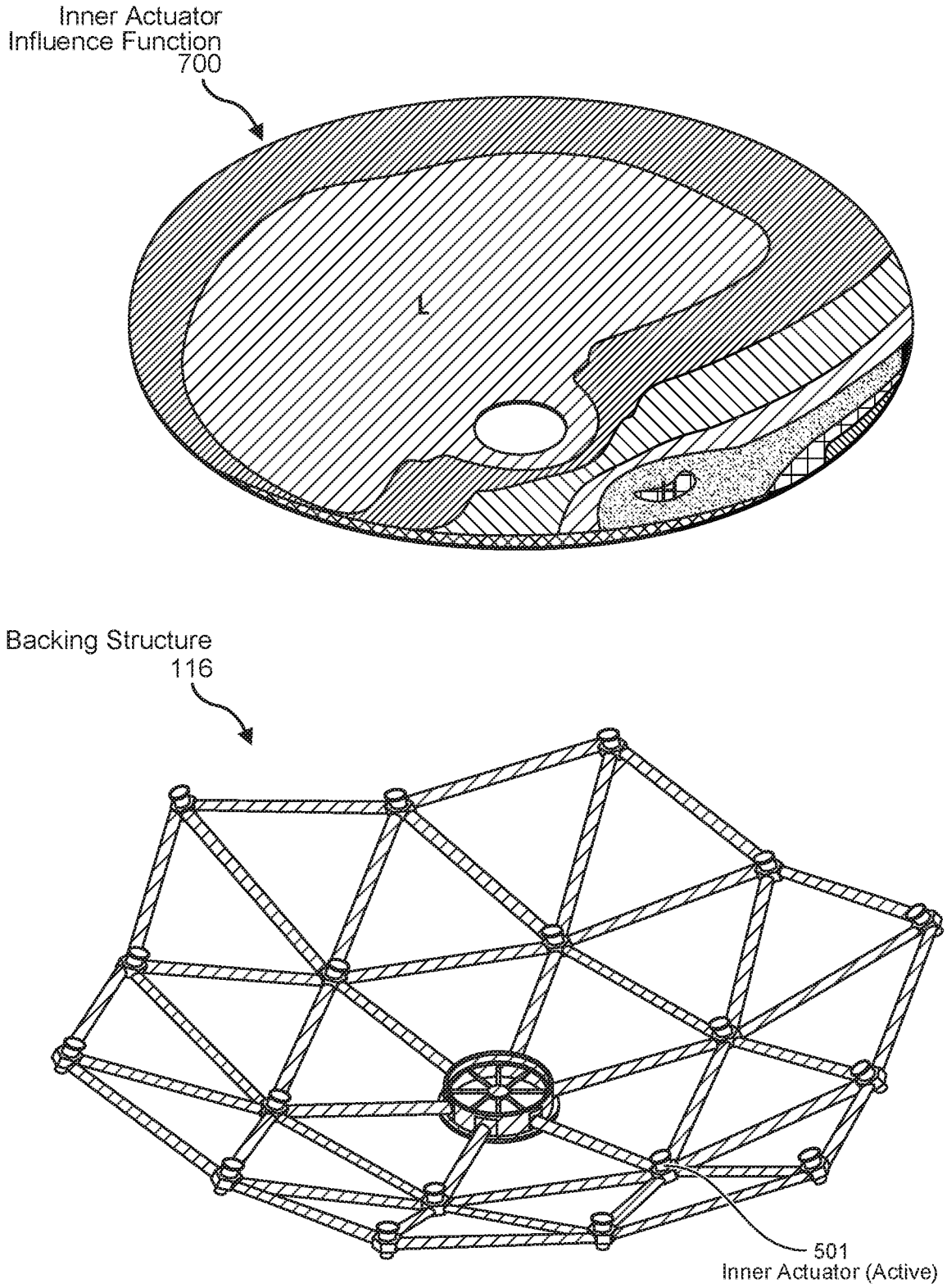
FIG. 7 is a perspective view of the backing structure of FIG. 5 with an active exemplary inner actuator, including a perspective view of the reflector graphically displaying an influence function of the inner actuator on the reflector.
Figure 8:
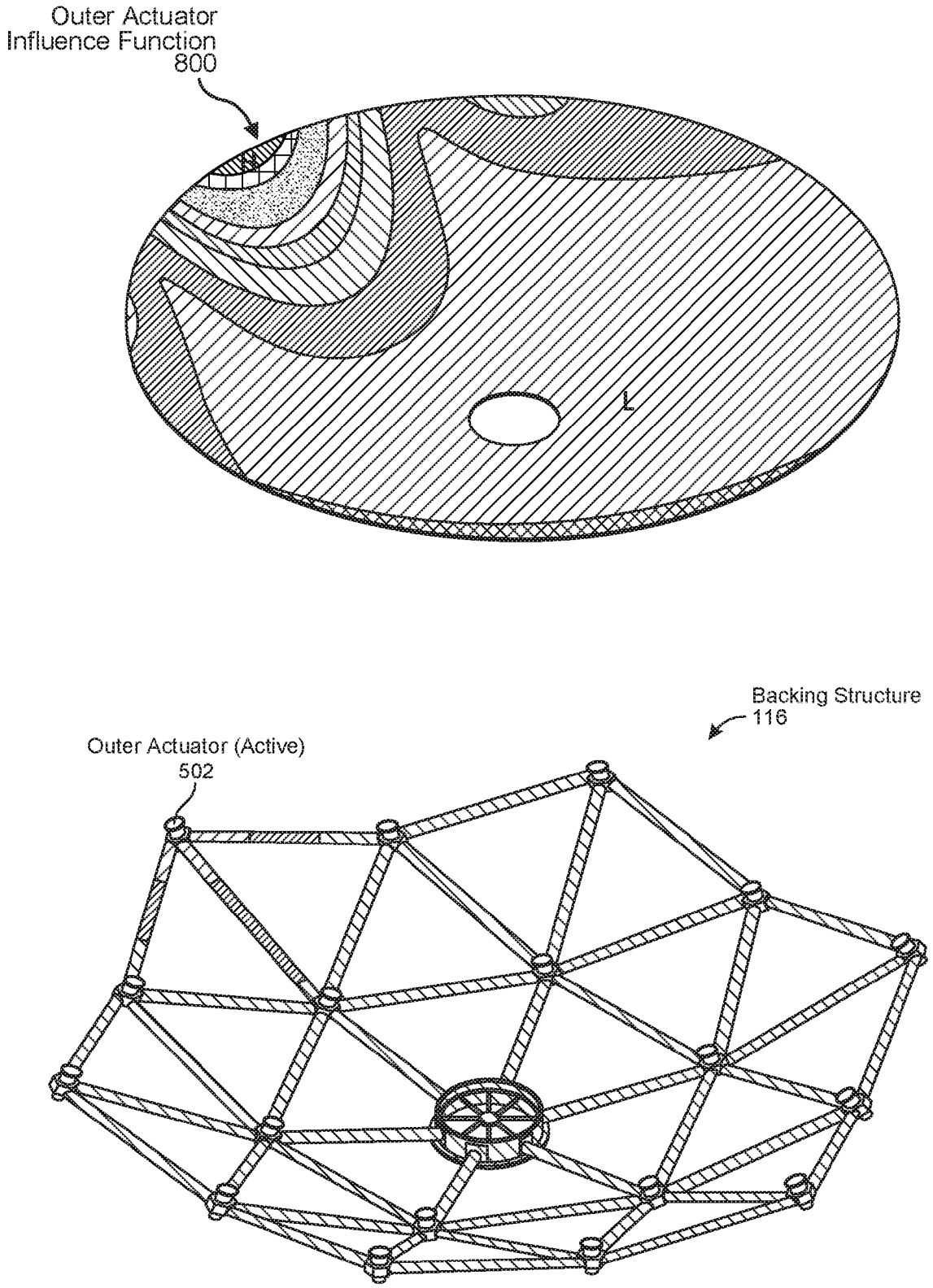
FIG. 8 is a perspective view of the backing structure of FIG. 5 with an active exemplary outer actuator, including a perspective view of the reflector graphically displaying an influence function of the outer actuator on the reflector.
Figure 9:
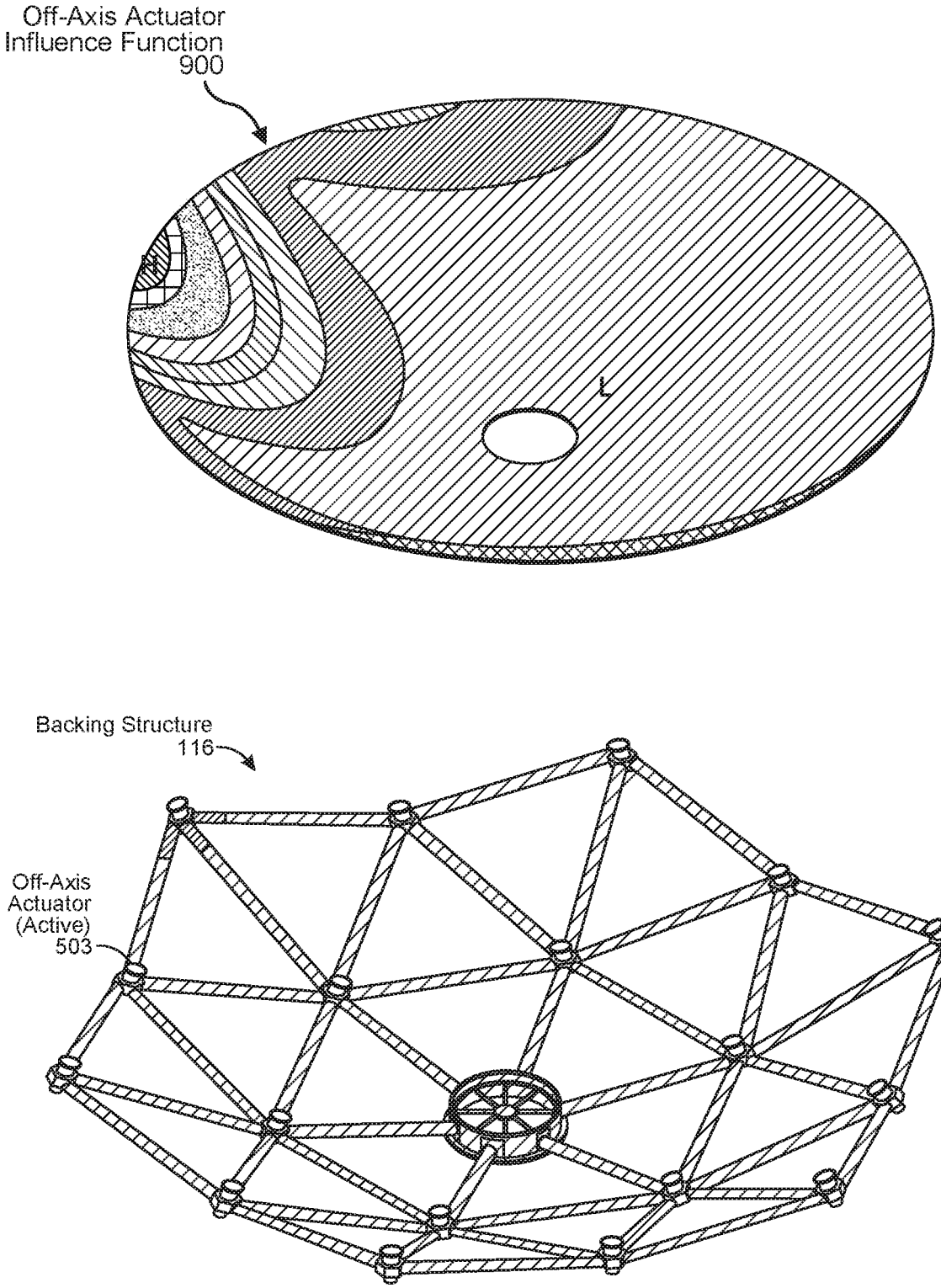
FIG. 9 is a perspective view of the backing structure of FIG. 5 with an active exemplary off-axis actuator, including a perspective view of the reflector graphically displaying an influence function of the off-axis actuator on the reflector.

FIGS. 7, 8, and 9 are perspective views of backing structure 116 denoting an actively positioned actuator 118 shown in association with a perspective view of reflector 112, graphically displaying an influence function of actuator 118 relative to reflector 112. More specifically, FIG. 7 depicts an inner actuator influence function 700 for an inner actuator 501, FIG. 8 illustrates an outer actuator influence function 800 for an outer actuator 502, and FIG. 9 shows an off-axis actuator influence function 900 for an off-axis actuator 503. In some embodiments, due to the structural symmetry associated with each actuator 188 within each group of actuators 118, all inner actuators 501 may be viewed as possessing the same influence function 700, and all outer actuators 502 and off-axis actuators 503 may possess the same corresponding influence functions 800 and 900, respectively.

In some embodiments, influence functions 700, 800, and 900 may be generated algorithmically, such as by way of finite element analysis prediction, given the physical characteristics of reflector 112 and the expected effect of a corresponding actuator 501, 502, and 503 set to one or more stroke positions. In yet other examples, influence functions 700, 800, and 900 may be generated empirically, such as via physical measurement of the change of position (e.g., distance from ideal) of multiple points of reflecting surface 302 of reflector 112.

As shown in each of FIGS. 7, 8, and 9, the effect of a single actuator 501, 502, and 503 exerting enough force to displace reflecting surface 302 a certain amount (e.g., fractions of an inch) at the point at which force is applied (as shown by the region marked with an "H") may also cause a lesser amount of displacement (as shown by the remaining regions, with the region marked "L" experiencing the least amount of displacement) in other areas of reflecting surface 302.

Figure 10B:
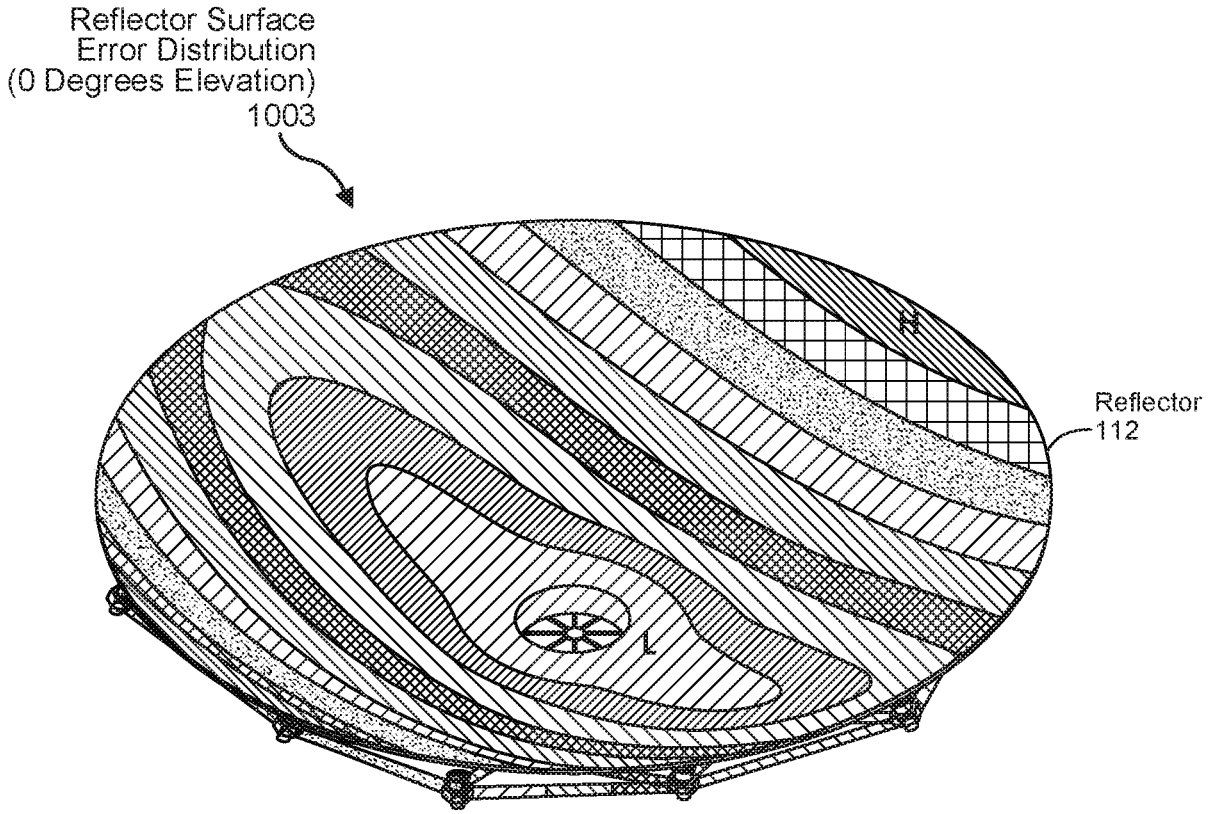

FIGS. 10A and 10B includes perspective views of reflector 112 of FIG. 3 in which a reflector surface error distribution 1001, 1002, and 1003 of reflector 112 is displayed graphically at three different elevation angles: 90 degrees (e.g., reflector 112 directed vertically), 50 degrees (e.g., reflector 112 directed 50 degrees upward from horizontal), and 0 degrees (e.g., reflector 112 directed horizontally). In each of these views, each region is associated with a range of positive displacement, and thus greater upward surface error (e.g., away from back surface 304). More specifically, the region experiencing the greatest displacement is marked "H", and the region experiencing the least displacement is marked "L". In each of the three views of FIGS. 10A and 10B, reflector 112 is nominally shown in a vertically-directed orientation to facilitate visual comparison of the surface error distribution at the different elevation angles of reflector 112. Moreover, in each of the views, the area of reflector 112 immediately surrounding central structure 510 of backing structure 116 is depicted with the least amount of displacement, as that portion of reflector 112 is directly affixed to backing structure 116 and lower integrating structure 104, and thus experiences the least movement of reflector 112 from a desired position at all elevation angles (e.g., as a result of being affected the least from gravity). In some embodiments, each reflector surface error distribution 1001, 1002, and 1003 may be determined algorithmically (e.g., using finite element analysis) or empirically (e.g., using physical measurement of an actual reflector 112 oriented at each of a range of elevation angles).

In the particular example of FIGS. 10A and 10B, reflector surface error distribution 1001 resulting from reflector 112 being directed vertically indicates a symmetrical distribution about central structure 510, with an overwhelming majority of reflecting surface 302 possibly being displaced axially. As reflector 112 is tilted downward toward horizontal, reflector surface error distribution 1002 at a 50-degree elevation angle becomes more diverse due to the gravity force vector not aligning with a central axis of reflector 112, causing some small bending of reflector 112 along a lateral axis not intersecting the central axis of reflector 112. Additionally, opposing edges of reflector 112 may deflect further away from back surface 304. Further, as reflector 112 is tilted horizontally toward the horizon, as shown in reflector surface error distribution 1003, bending of reflector 112 may be focused along a lateral axis that intersects a center of central structure 510, with top and bottom edges of reflector 112 being displaced away from back surface 304. While not illustrated herein, other angles of elevation for reflector 112 may result in other surface error distributions that may represent transitional distributions between those explicitly shown in FIGS. 10A and 10B.

In some embodiments, for each surface error distribution for each angle of elevation, actuators 118 may be employed to apply force to back surface 304 to reduce or substantially eliminate the surface errors of reflector 112. To that end, in some examples, the influence functions of actuators 118 (e.g., as depicted in FIGS. 7-9) may be combined with reflector surface error distribution 1001, 1002, and 1003 at each elevation angle of interest for reflector 112 to determine a desired stroke position for each actuator 118 to reduce or substantially eliminate reflector surface error distribution 1001, 1002, and 1003.

Figure 11:
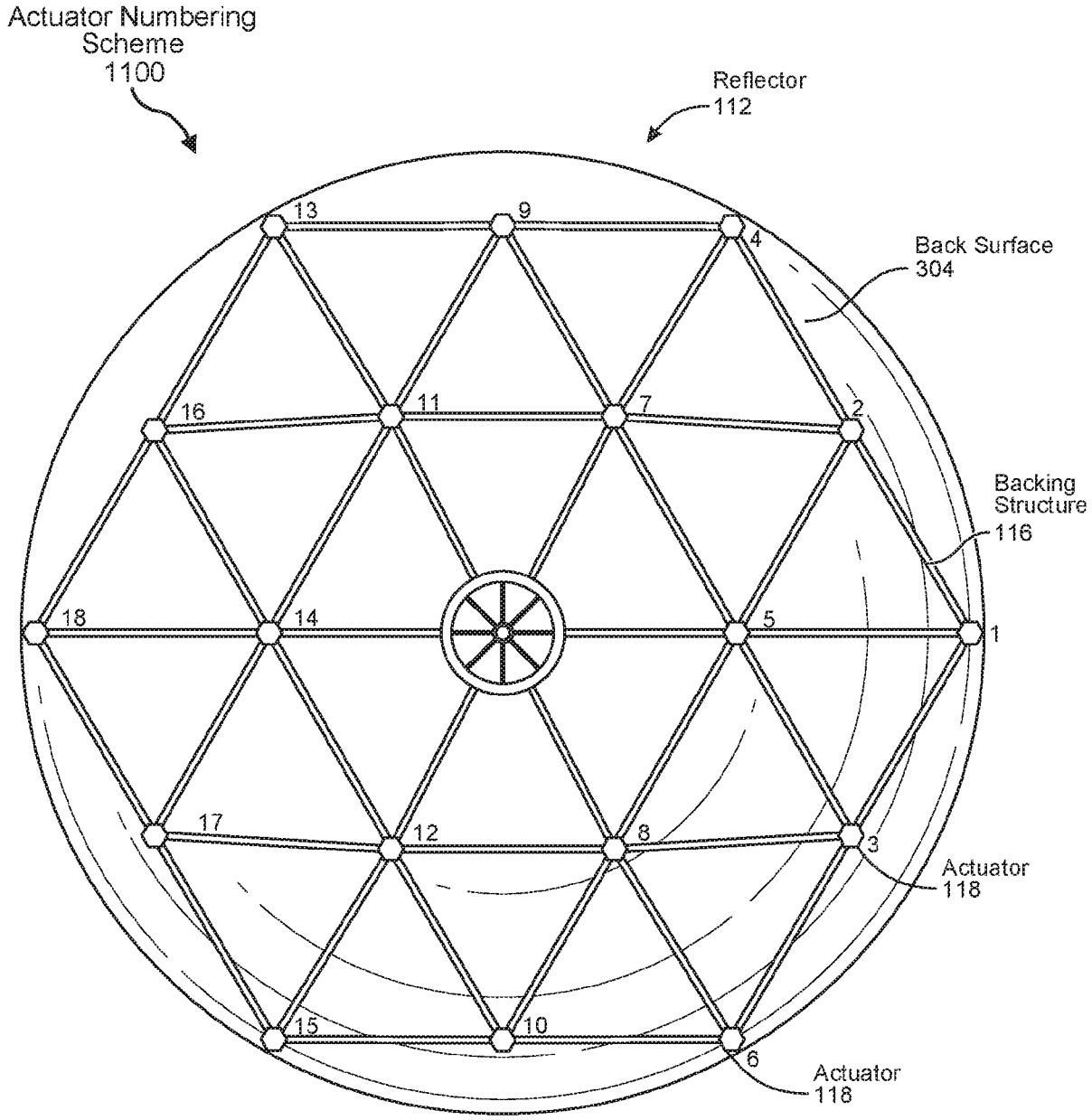
FIG. 11 is a bottom view of the reflector and associated backing structure in which each actuator is numbered for further reference below.
Figure 12A:
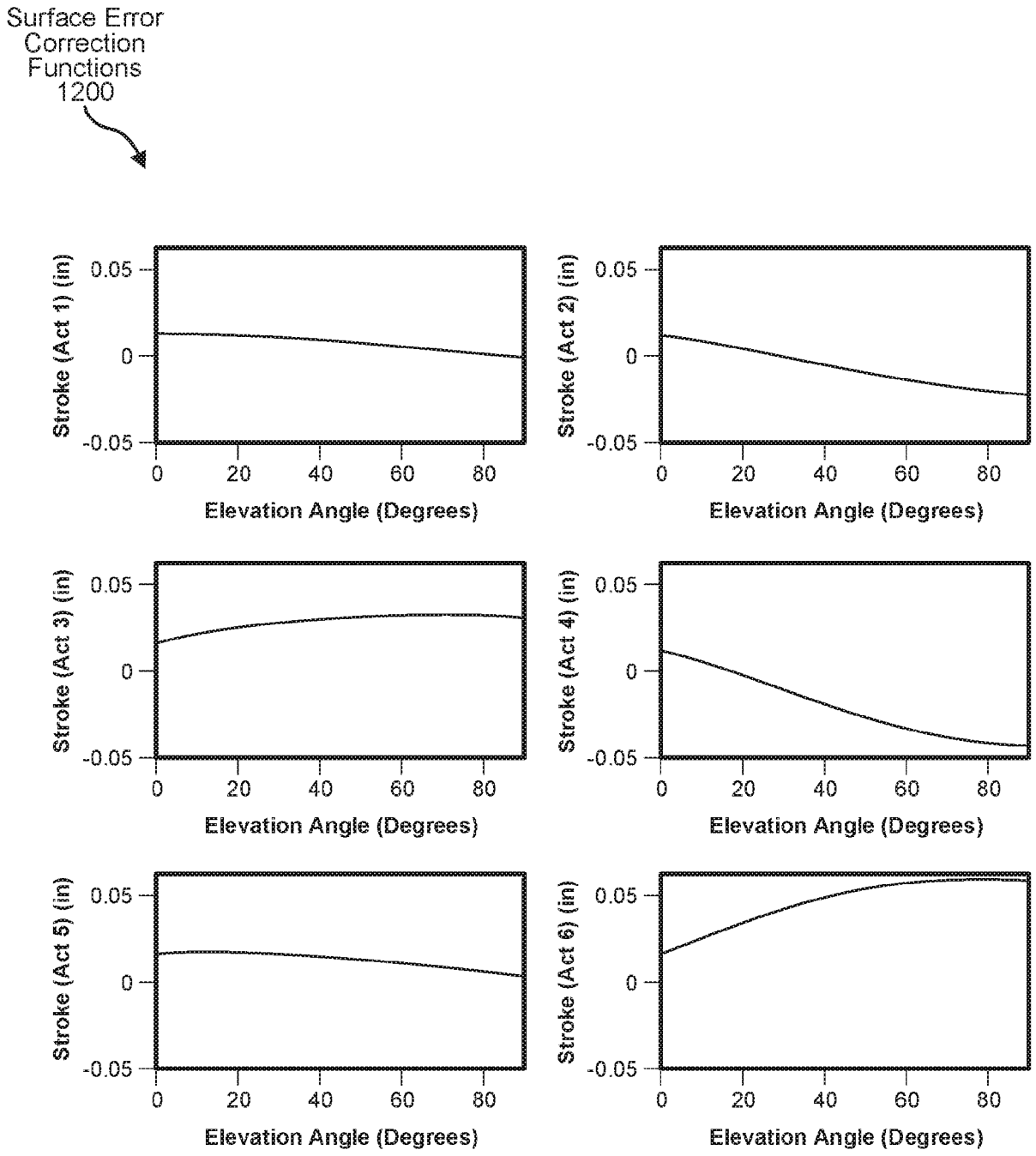
FIGS. 12A, 12B, and 12C are a set of graphs of exemplary surface error correction functions relating a desired actuator position or stroke setting of each actuator over a range of elevation angles of the reflector to reduce surface error of the reflector.
Figure 12B:
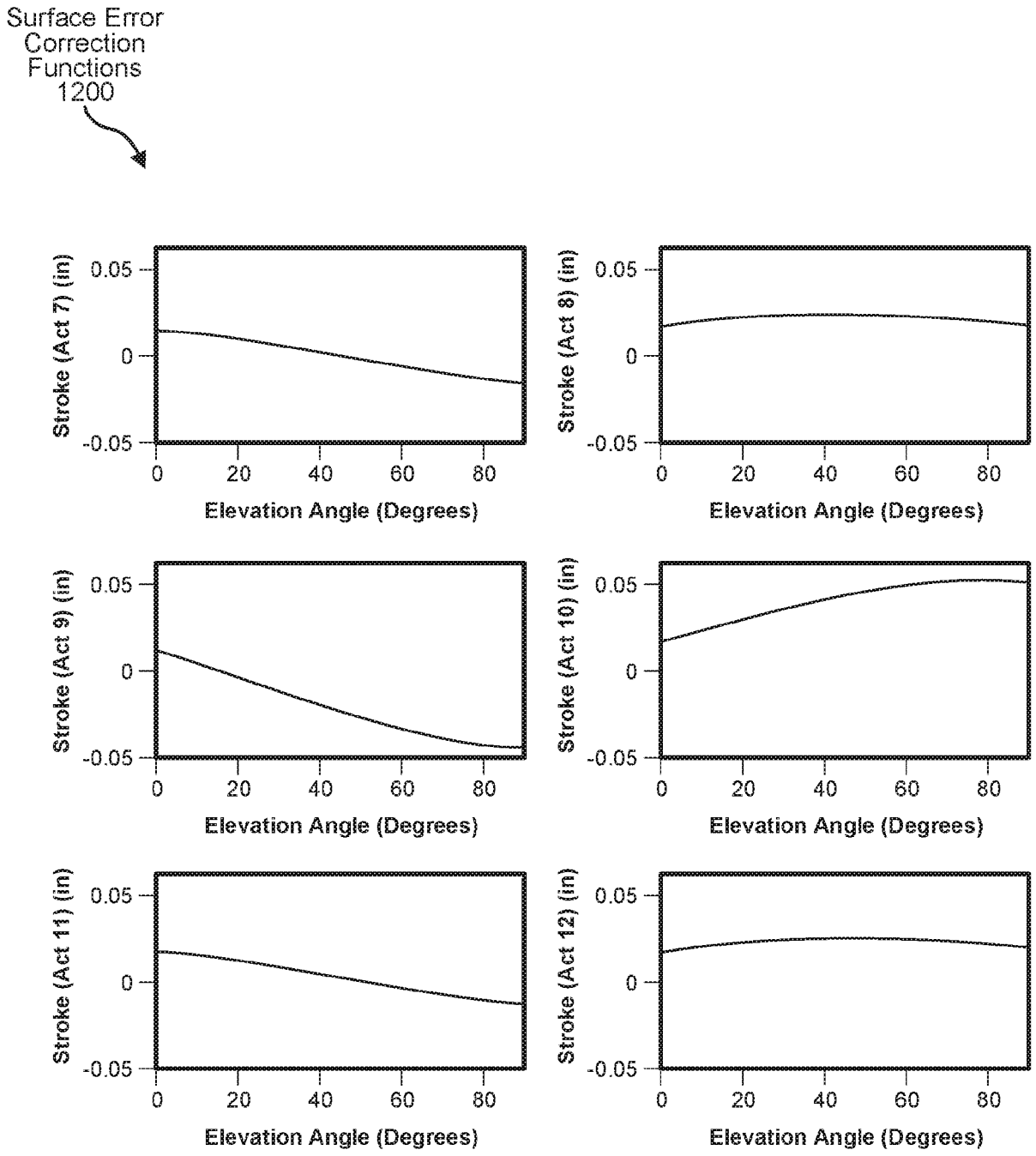
Figure 12C:
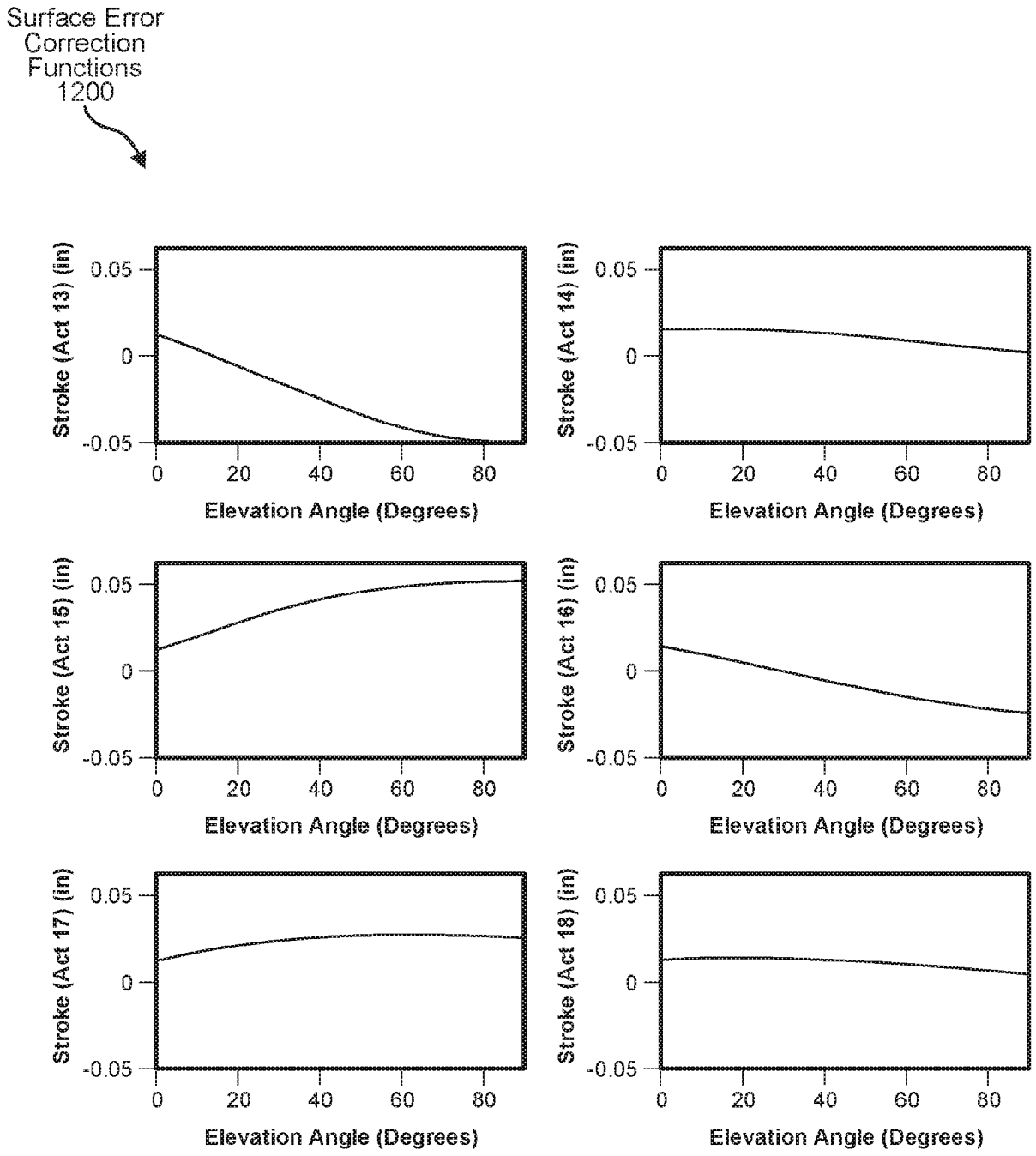

FIG. 11 is a bottom view of reflector 112 showing back surface 304 in conjunction with actuators 118 of backing structure 116, where each actuator 118 is labeled numerically to relate each actuator 118 a corresponding surface error correction function 1200 (graphed in FIGS. 12A, 12B, and 12C) for that actuator 118. More specifically, each actuator 118 is associated with its surface error correction function 1200 by way of a graph that plots a desired stroke position (in inches) for each elevation angle of reflector 112 (in degrees). In this example, surface error correction functions 1200 were generated algorithmically for a particular reflector 112 design and backing structure 116 (e.g., by finite element analysis or other computational means). Consequentially, changes in the design of any of the structural components of ground antenna assembly 110 may yield significantly different surface error correction functions 1200.

Therefore, in some embodiments, control and data subsystem 402 may employ some form of surface error correction functions 1200 to operate actuators 118 to minimize surface errors in reflecting surface 302 of reflector 112. For example, while the graphs depicting surface error correction functions 1200 are continuous in nature, control and data subsystem 402 may associate discrete values for possible elevation angles of reflector 112 with corresponding discrete actuator (stroke) positions for each actuator 118. FIG. 13 depicts a surface error correction lookup table 1300 in which each elevation angle 1304 is associated with a number denoting each individual actuator 118 by way of actuator number 1302 (e.g., such as those shown in FIG. 11) to provide a corresponding actuator (stroke) position (e.g., in inches, although millimeters or some other unit of length may be utilized). In the particular example of FIG. 13, only integer elevation angles 1304 are employed. However, other non-integer elevation angles 1304 may be employed using surface error correction lookup table 1300 by way of interpolation to provide a suitable actuator position for such non-integer elevation angles 1304. In other examples, surface error correction lookup table 1300 may include a greater number of elevation angles 1304 to include as many non-integer elevation angles 1304 as desired. Also, while FIG. 13 illustrates a single surface error correction lookup table 1300, other embodiments may employ a separate lookup table for each actuator 118, or some other data storage scheme.

In various embodiments described above, the desired position for each actuator 118 depends upon the current elevation angle at which reflector 112 is currently oriented. In other examples, system 400 of FIG. 4 may employ one or physical sensors that measure some physical aspect of reflector 112 that indicates a current surface error of reflecting surface 302. For example, satellite communication ground element 100 may be outfitted with one or more scanning components (e.g., optical scanners) that detect a current position or displacement of multiple locations on reflecting surface 302. Based on that information, control and data subsystem 402 may periodically or continually operate actuators 118 based on the current position or displacement data received from the one or more optical scanners. In some examples, an optical scanner may be placed on or near sub-reflector 114 to garner a view of most of reflecting surface 302. Further, in some embodiments, sub-reflector 115 may be a continuously rotating sub-reflector 114 that dithers the received signal so that antenna positioner 102 may refine the orientation of ground antenna assembly 110 for maximum received signal strength and fidelity. Accordingly, an optical scanner mounted atop sub-reflector 114 may also rotate, thus facilitating a 360-degree scan of reflecting surface 302 to generate the current position or displacement data.

Figure 14:
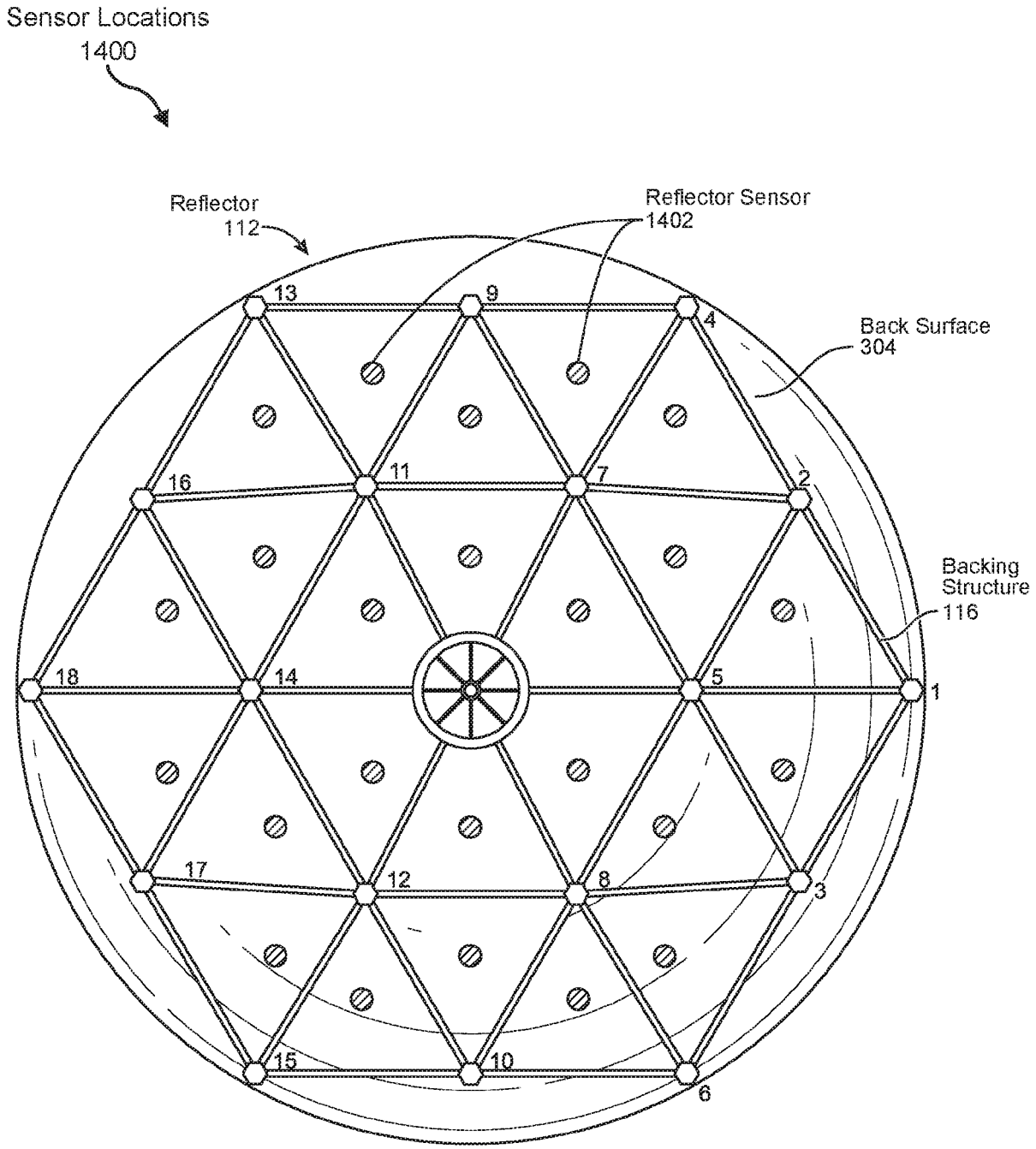
FIG. 14 is a bottom view of the reflector and associated backing structure, where a plurality of reflector sensors that sense a physical state of the reflector are shown.

Other types of physical sensors that generate data indicative of surface error data may be employed in other embodiments. FIG. 14, for example, is a bottom view of reflector 112 depicting a number of reflector sensors 1402 coupled to back surface 304. In one embodiment, reflector sensors 1402 may be strain gauges that measure strain along back surface 304. The resulting strain measures may be indicative of surface error at various locations on reflecting surface 302 of reflector 112. Based on these measurements, control and data subsystem 402 may generate desired stroke positions for each actuator 118 to reduce that surface error over reflecting surface 302.

In some embodiments, one or more physical sensors may be employed in lieu of the current elevation angle of reflector 112 to adjust actuators 118 to reduce surface error. In other examples, one or more physical sensors may be employed in addition to the current elevation angle of reflector 112, such as to provide a "fine adjustment" for actuators 118 in cases in which setting the stroke position for each actuator 118 based solely on the current elevation angle does not reduce the surface error of reflecting surface 302 to an acceptable level.

Figure 15:
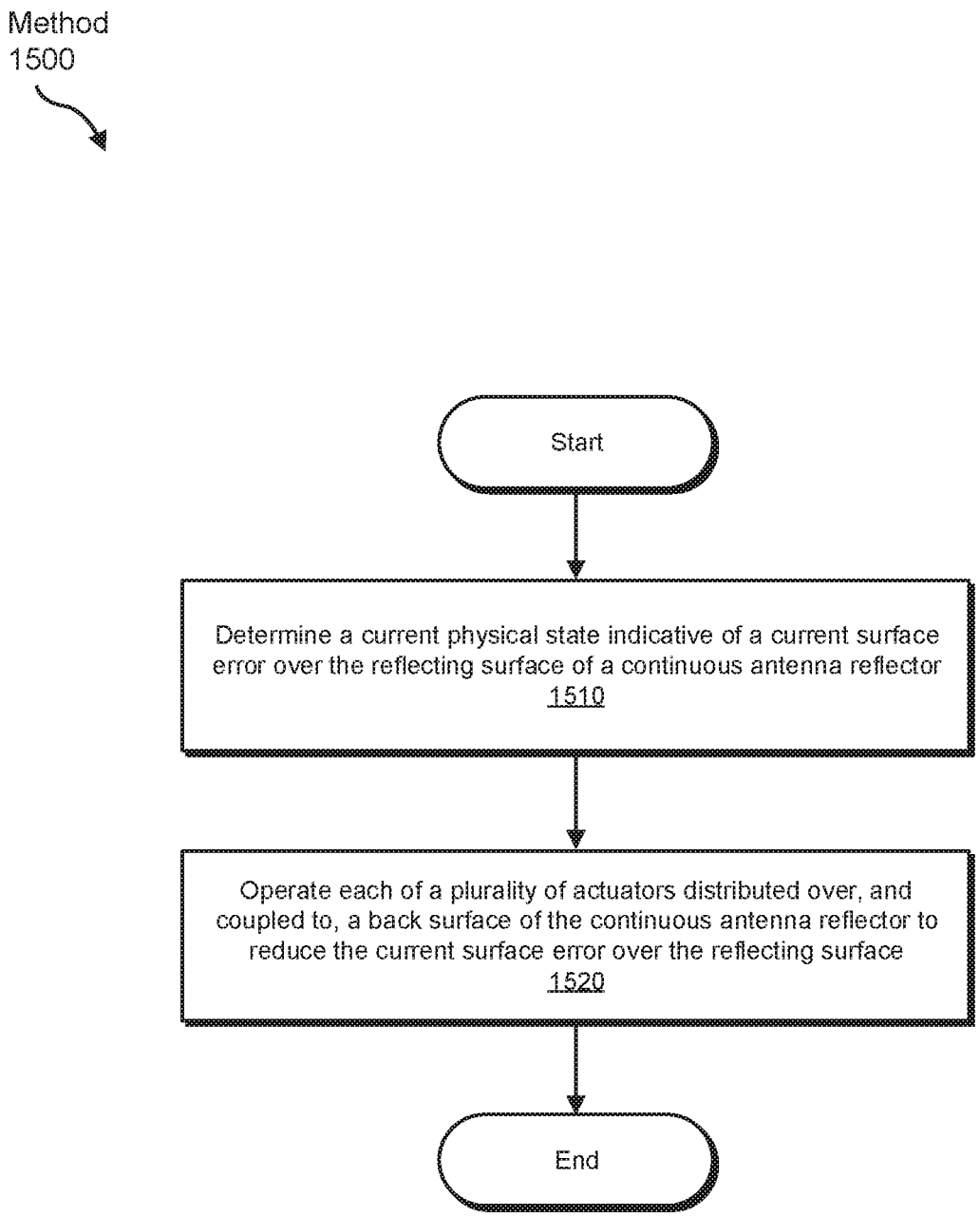
FIG. 15 is a flow diagram of an exemplary method of reducing surface error of an antenna reflector surface.

FIG. 15 is a flow diagram of an exemplary method 1500 for reducing surface error of a continuous antenna reflector (e.g., reflector 112). The steps shown in FIG. 15 may be performed by any suitable system, including system 400 of FIG. 4. However, other systems not specifically described herein may also benefit from application of method 1500. In one example, method 1500 of FIG. 15, as well as other methods described hereinafter, may represent an algorithm whose structure includes and/or is represented by multiple sub-steps, examples of which will be provided in greater detail below.

In method 1500, at step 1510, a current physical state indicative of a current surface error over the reflecting surface (e.g., reflecting surface 302) of the continuous antenna reflector may be determined. At step 1520, each of a plurality of actuators (e.g., actuators 118) distributed over, and coupled to, a back surface (e.g., back surface 304) of the continuous antenna reflector to reduce the surface error over the reflecting surface.

Figure 16:
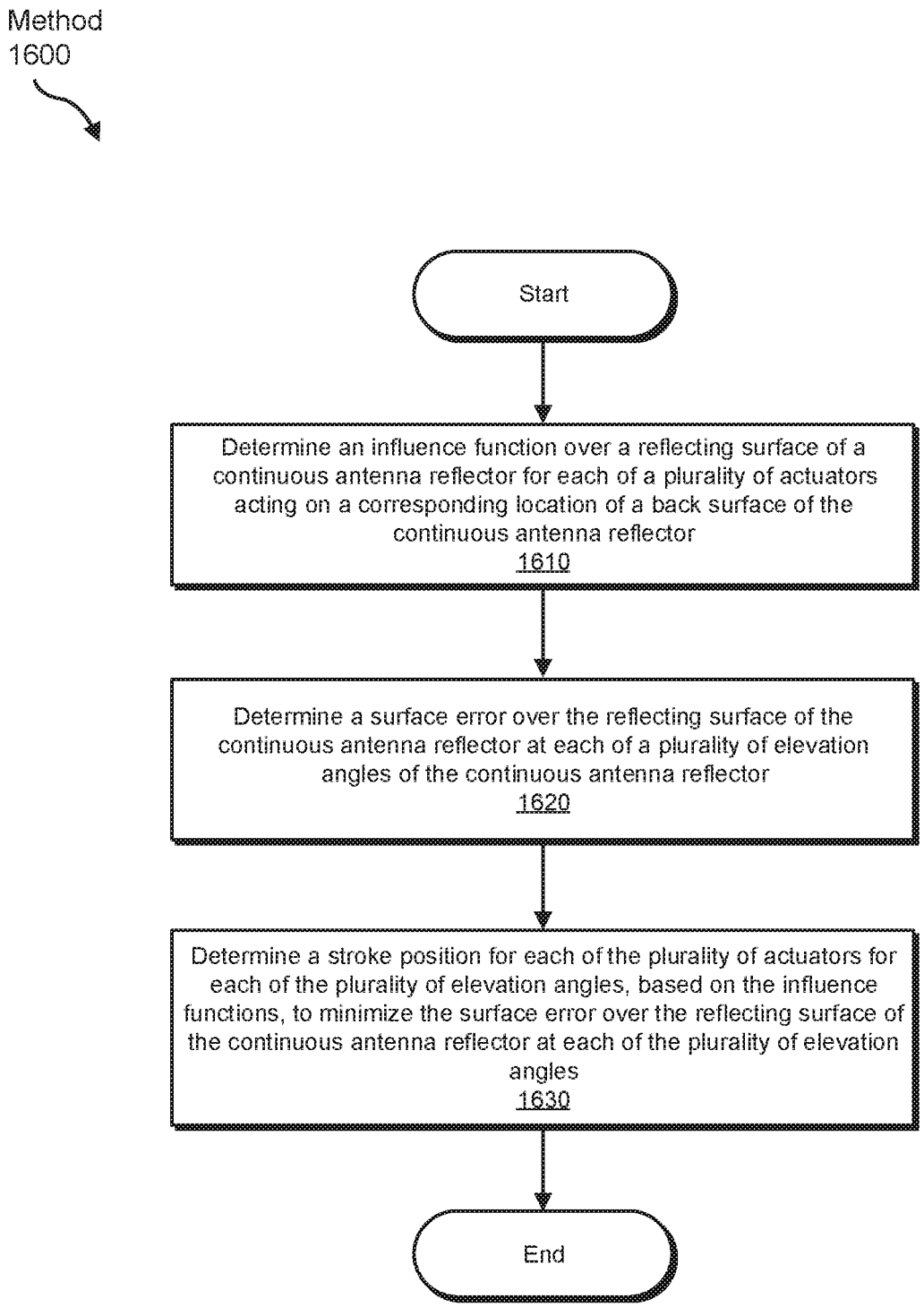
FIG. 16 is a flow diagram of an exemplary method of generating desired actuator settings for a plurality of elevation angles of the antenna reflector.

In some embodiments, the current physical state may be a current elevation angle at which the continuous antenna reflector is oriented, as the effects of gravity on the surface error may dominate other potential sources of surface error. In such embodiments, the flow diagram of FIG. 16 depicts a method 1600 for determining a setting (e.g., a stroke position) for each of the actuators at various elevation angles of the continuous antenna reflector to reduce or substantially eliminate the surface error. As discussed above, this setting determination may be performed algorithmically (e.g., using finite element analysis or other programmatic means) or empirically (e.g., using physical measurements) on a physical reflector (e.g., using a typical reflector to be employed or on each individual reflector to be deployed in the field).

In method 1600, at step 1610, an influence function over the reflecting surface of the continuous antenna reflector may be determined for each of the plurality of actuators acting on a corresponding location of the back surface of the continuous antenna reflector. As described above, an influence function for an actuator may describe the physical effect (e.g., displacement) of that actuator on the reflecting surface of the reflector. At step 1620, a surface error over the reflecting surface of the antenna may be determined at each of a plurality of elevation angles of the reflector. At step 1630, a stroke position for each of the plurality of actuators may be determined for each of the plurality of elevation angles, based on the influence functions, to minimize the surface error over the reflecting surface at each of the elevation angles.

Figure 17:
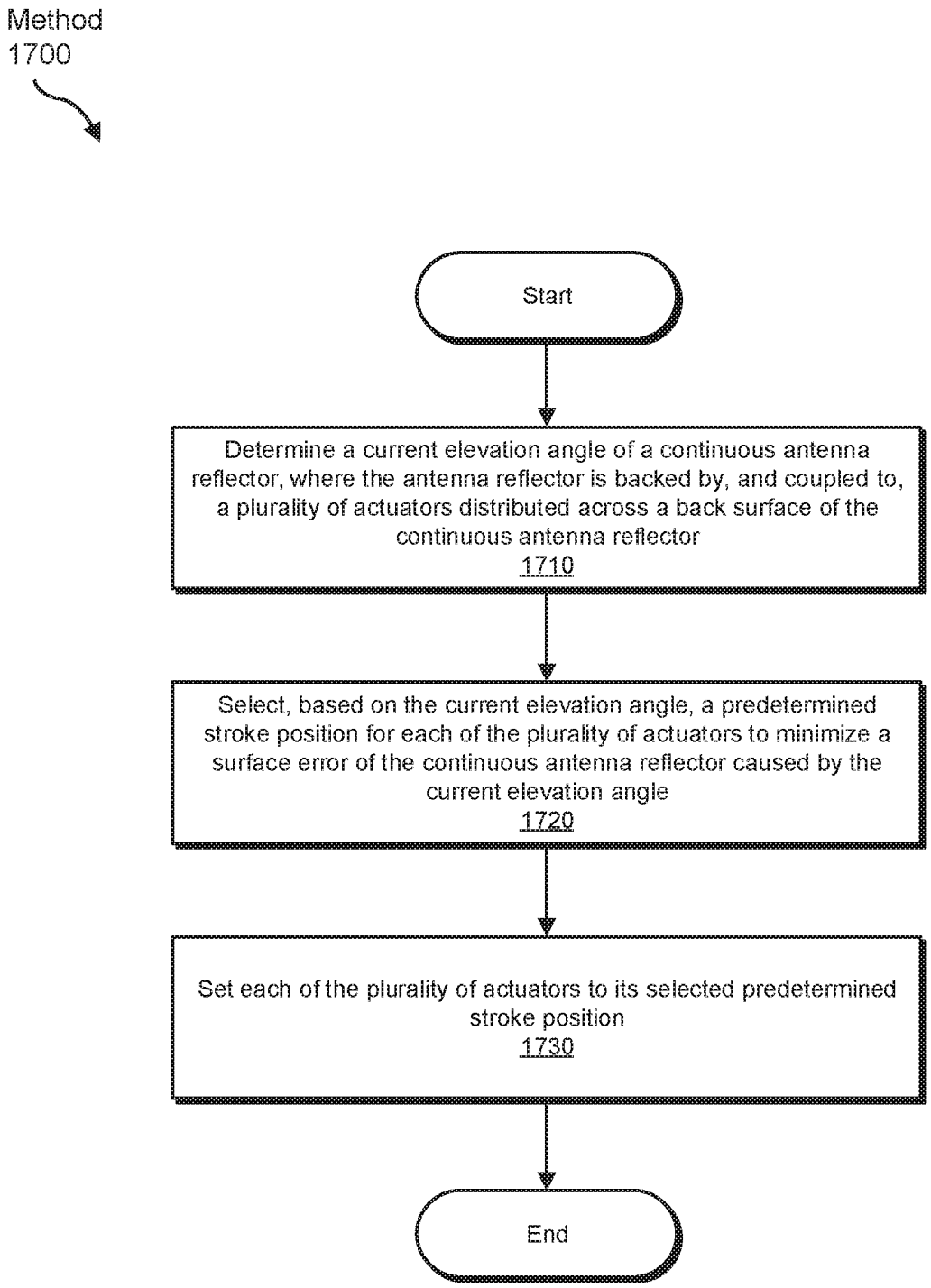
FIG. 17 is a flow diagram of another exemplary method of reducing surface error of an antenna reflector surface employing the desired actuator settings of FIG. 16.

In at least some embodiments, the stroke positions for each actuator at each elevation angle considered may be stored for use during actual operation of the reflector, as described in method 1700, shown by way of the flow diagram in FIG. 17. In method 1700, at step 1710, a current elevation angle of the continuous antenna reflector may be determined. At step 1720, based on the current elevation angle, a predetermined stroke position for each of the plurality of actuators (e.g., as generated via method 1600) may be selected to minimize the surface error of the reflector caused by the current elevation angle. At step 1730, each of the plurality of actuators may then be set to its selected predetermined stroke position, thus minimizing the surface error.

Figure 18:
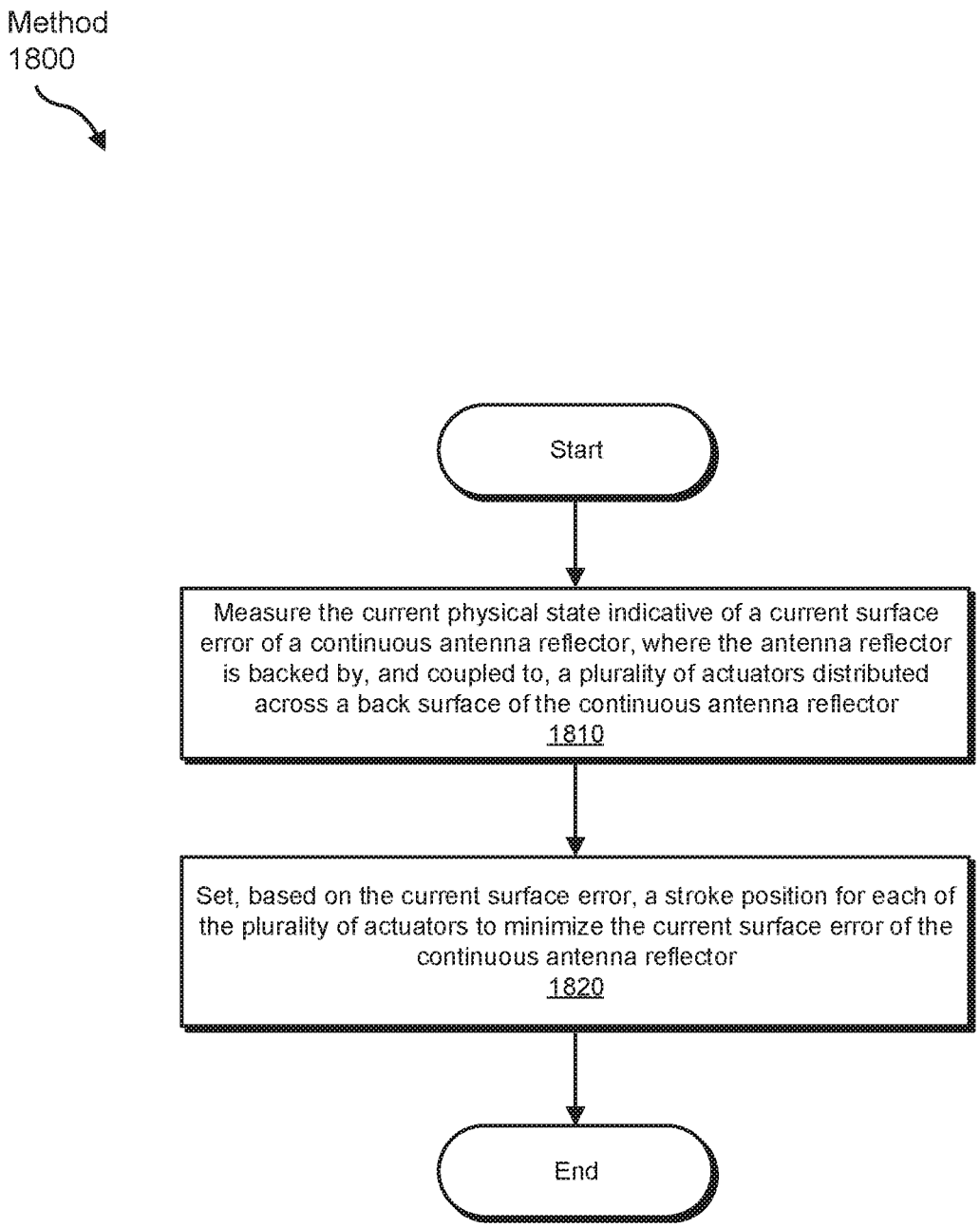
FIG. 18 is a flow diagram of another exemplary method of reducing surface error of an antenna reflector using one or more measurements of a current physical state of the antenna reflector.

In some examples, in lieu of or addition to the use of the current elevation angle to operate the actuators, physical sensors (e.g., one or more optical scanning sensors, a plurality of strain gauges, and so on) may be employed to determine a current physical state that may be indicative of a current surface error so that the actuators may be set to reduce or minimize that error. For example, FIG. 18 is a flow diagram of a method 1800 for reducing a current surface error based on information from such sensors. At step 1810, the current physical state indicative of the current surface error of the reflector may be measured. At step 1820, based on the current surface error, the stroke position for each of the plurality of actuators may be set to minimize the current surface error indicated by the measured current physical state.

Figure 19:
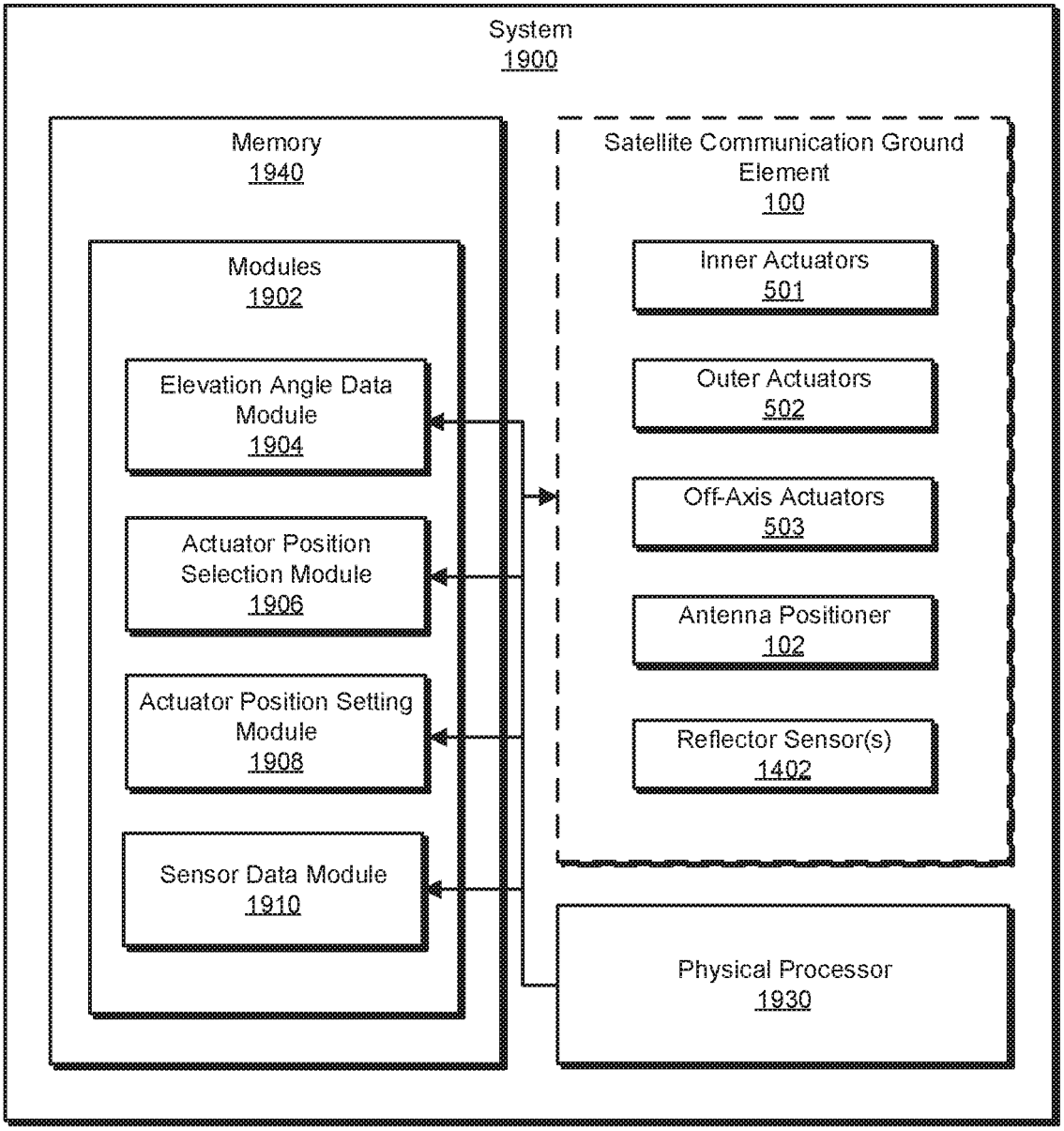
FIG. 19 is a block diagram of an exemplary system of reducing surface error of an antenna reflector.

FIG. 19 is a block diagram of a system 1900 for reducing surface error of a continuous antenna reflector (e.g., reflector 112). System 1900, in some embodiments, may serve as system 400 of FIG. 4. System 1900 may include one or more modules 1902 for performing one or more tasks. As will be explained more fully below, modules 1902 may include one or more of an elevation angle data module 1904, an actuator position selection module 1906, an actuator position setting module 1908, and a sensor data module 1910.

One or more of modules 1902 in FIG. 19 may represent one or more software applications or programs that, when executed by a computing device, may cause the computing device to perform one or more tasks. System 1900 may also include one or more memory devices, such as memory 1940. Memory 1940 generally represents any type or form of volatile or non-volatile storage device or medium capable of storing data and/or computer-readable instructions, as noted above, as well as store, load, and/or maintain one or more of modules 1902. Moreover, system 1900 may also include one or more physical processors, such as physical processor 1930 that generally represents any type or form of hardware-implemented processing unit capable of interpreting and/or executing computer-readable instructions. In one example, physical processor 1930 may access and/or modify one or more of modules 1902 stored in memory 1940. Additionally or alternatively, physical processor 1930 may execute one or more of modules 1902 to reduce surface error over a reflecting surface (e.g., reflecting surface 302) of a continuous antenna reflector (e.g., reflector 112).

As illustrated in FIG. 19, exemplary system 1900 may also include one or more system hardware components of ground communication antenna element 100, such as actuators 118 (e.g., inner actuators 502, outer actuators 502, and off-axis actuators 503) to apply force to back surface 304 of reflector 112, as described above. Further, satellite communication ground element 100 may include antenna positioner 102 (e.g., for orienting ground antenna assembly 110 in terms of azimuth and elevation to maintain a communication link with an orbiting satellite, as described above), as well as one or more reflector sensors 1402 (e.g., optical scan sensors, strain gauges, or the like) to determine a current physical state of reflector 112.

In some embodiments, elevation angle data module 1904 may receive data (e.g., via antenna positioner 102) regarding a current elevation angle of reflector 112, which may be employed to adjust actuators 118 to reduce the surface error of reflecting surface 302, as described above. Actuator position selection module 1906, in some examples, may retrieve stored data (e.g., from surface error correction lookup table 1300) to determine a desired actuator (e.g. stroke) position for each actuator 118 given a current elevation angle for reflector 112. In some embodiments, actuator position setting module 1908 may communicate with actuators 118 (e.g., inner actuators 501, outer actuators 502, and off-axis actuators 503) to set the desired stroke position for each actuator 118 (e.g., based on data retrieved by actuator position selection module 1906). Also, in some embodiments, sensor data module 1910 may retrieve sensor measurements from reflector sensors 1402 to determine a current physical state of reflector 112. In some examples, actuator position selection module 1906 and actuator position setting module 1908 may use such measurements to reduce the current surface error of reflecting surface 302, either as a fine adjustment to the setting of actuators 118 based on the current elevation angle, or as a sole source of information by which to reduce or eliminate current surface errors.

In view of the discussion presented above in conjunction with FIGS. 1-19, a surface error of a continuous antenna reflector may be reduced or substantially minimized. In some embodiments, the ability to reduce surface error of a continuous antenna reflector in such a manner may facilitate the use of relatively lightweight materials for reflectors of significant size while retaining the ability to transmit and receive high-frequency RF signals to and from orbiting satellites that possess limited capabilities in terms of link aperture, transmission power, and the like.

EXAMPLE EMBODIMENTS

Example 1: A method for reducing a surface error of a continuous antenna reflector may include (1) determining a current physical state regarding an antenna assembly, where the antenna assembly includes (a) a sub-reflector that receives a wireless signal and reflects the wireless signal to a feed structure for processing, (b) a continuous antenna reflector that receives the wireless signal at a reflecting surface that reflects the wireless signal to the sub-reflector, where the current physical state is indicative of a current surface error over the reflecting surface relative to the sub-reflector, and (c) a backing structure coupled to a back surface of the continuous antenna reflector opposite the reflecting surface, wherein the backing structure comprises a plurality of actuators distributed over, and coupled to, the back surface, and (2) operating each of the plurality of actuators in a manner that reduces the current surface error based on the current physical state.

Example 2: The method of Example 1, where each of the plurality of actuators may include a linear actuator oriented substantially normal to a corresponding point on the back surface at which the linear actuator is coupled.

Example 3: The method of either Example 1 or Example 2, where the plurality of actuators may be coupled together using a plurality of linear elements, where at least some of the plurality of linear elements may include (1) a first end connected to a first one of the plurality of actuators, and (2) a second end connected to a second one of the plurality of actuators.

Example 4: The method of Example 3, where (1) each of the plurality of linear elements may have a substantially same length, and (2) the plurality of actuators and the plurality of linear elements may form a plurality of substantially equilateral triangles.

Example 5: The method of either Example 1 or Example 2, where (1) the plurality of actuators may be arranged into a plurality of groups, and (2) the plurality of actuators of each of the plurality of groups may be positioned at a substantially same distance from a center of the back surface of the continuous antenna reflector.

Example 6: The method of Example 5, where the plurality of actuators of each of the plurality of groups may be positioned equidistant about a circumference at the substantially same distance from the center of the back surface.

Example 7: The method of either Example 1 or Example 2, wherein (1) the method may further include (a) determining a surface error over the reflecting surface at each of a plurality of elevation angles of the continuous antenna reflector, (b) determining a stroke position for each of the plurality of actuators for each of the plurality of elevation angles to minimize the surface error over the reflecting surface, and (c) storing the determined stroke position for each of the plurality of actuators for each of the plurality of elevation angles, (2) determining the current physical state regarding the antenna assembly may include determining a current elevation angle of the continuous antenna reflector, and (3) operating each of the plurality of actuators may include setting a current stroke position for each of the plurality of actuators to the corresponding stored stroke position based on the current elevation angle.

Example 8: The method of Example 7, where (1) the method further may include determining an influence function over the reflecting surface for each of the plurality of actuators, where the influence function for each of the plurality of actuators describes movement of the reflecting surface in response to operation of the corresponding actuator, and (2) determining the stroke position for each of the plurality of actuators for each of the plurality of elevation angles may be based on the influence functions.

Example 9: The method of Example 7, where storing the determined stroke position for each of the plurality of actuators for each of the plurality of elevation angles may include storing the determined stroke positions in one or more lookup tables relating each of the plurality of elevation angles to the determined stroke position for each of the plurality of actuators.

Example 10: The method of either Example 1 or Example 2, where (1) determining the current physical state regarding the antenna assembly may include measuring a current physical state of the continuous antenna reflector using at least one sensor that senses the current physical state, and (2) operating each of the plurality of actuators may be based on the current physical state of the continuous antenna reflector.

Example 11: The method of Example 10, where the method may further include calculating a current surface error over the reflecting surface based on the current physical state of the continuous antenna reflector, wherein operating each of the plurality of actuators is based on the current surface error.

Example 12: The method of Example 10, where (1) the at least one sensor may include a distance sensor that measures a current location of each of a plurality of positions on at least one of the reflecting surface or the back surface, and (2) the current physical state of the continuous antenna reflector may include the current location of each of the plurality of positions.

Example 13: The method of Example 10, where (1) the at least one sensor may include a plurality of strain gauges coupled to at least one of the reflecting surface or the back surface, where each of the plurality of strain gauges measures a current strain experienced by the at least one of the reflecting surface or the back surface at a location of the strain gauge, and (2) the current physical state of the continuous antenna reflector may include the current strain measured by each of the plurality of strain gauges.

Example 14: A communication element may include (1) an antenna assembly including (a) a feed structure that receives and processes a wireless signal, (b) a sub-reflector that receives the wireless signal and reflects the wireless signal to the feed structure, (c) a continuous antenna reflector that receives the wireless signal at a reflecting surface that reflects the wireless signal to the sub-reflector, and (d) a backing structure coupled to a back surface of the continuous antenna reflector opposite the reflecting surface, where the backing structure includes a plurality of actuators distributed over, and coupled to, the back surface, and (2) a control system that (a) determines a current physical state of the continuous antenna reflector that is indicative of a current surface error over the reflecting surface relative to the sub-reflector, and (2) operates the plurality of actuators in a manner that reduces the current surface error based on the current physical state.

Example 15: The communication element of Example 14, where the backing structure may further include a plurality of linear elements, where at least some of the plurality of linear elements mechanically couple a first of the plurality of actuators to a second of the plurality of actuators.

Example 16: The communication element of either Example 14 or Example 15, where (1) the communication element may further include a memory storing data relating each of a plurality of elevation angles of the continuous antenna reflector to a stroke position for each of the plurality of actuators, (2) the current physical state of the continuous antenna reflector may include a current elevation angle of the continuous antenna reflector, and (3) the control system may operate the plurality of actuators by setting each of the plurality of actuators to the stroke position stored in the memory associated with the current elevation angle.

Example 17: The communication element of either Example 14 or Example 15, where (1) the communication element may further include at least one sensor that senses the current physical state of the continuous antenna reflector, and (2) the control system may operate the plurality of actuators by setting each of the plurality of actuators to a corresponding stroke position based on the current physical state of the continuous antenna reflector.

Example 18: The communication element of Example 17, where the at least one sensor may include a distance sensor that measures a current location of each of a plurality of positions on at least one of the reflecting surface or the back surface.

Example 19: The communication element of Example 17, where the at least one sensor may include a plurality of strain gauges coupled to at least one of the reflecting surface or the back surface, where each of the plurality of strain gauges measures a current strain experienced by the at least one of the reflecting surface or the back surface at a location of the strain gauge.

Example 20: A system may include (1) an antenna assembly including (a) a feed structure that receives and processes a wireless signal, (b) a sub-reflector that receives the wireless signal and reflects the wireless signal to the feed structure, (c) a continuous antenna reflector that receives the wireless signal at a reflecting surface that reflects the wireless signal to the sub-reflector, and (d) a backing structure coupled to a back surface of the continuous antenna reflector opposite the reflecting surface, where the backing structure includes a plurality of actuators distributed over, and coupled to, the back surface, (2) at least one physical processor, and (3) physical memory including computer-executable instructions that, when executed by the physical processor, cause the physical processor to (a) determine a current physical state indicative of a current surface error over the reflecting surface relative to the sub-reflector, and (b) operate each of the plurality of actuators in a manner that reduces the current surface error based on the current physical state.

As detailed above, the computing devices and systems described and/or illustrated herein broadly represent any type or form of computing device or system capable of executing computer-readable instructions, such as those contained within the modules described herein. In their most basic configuration, these computing device(s) may each include at least one memory device and at least one physical processor.

In some examples, the term "memory device" generally refers to any type or form of volatile or non-volatile storage device or medium capable of storing data and/or computer-readable instructions. In one example, a memory device may store, load, and/or maintain one or more of the modules described herein. Examples of memory devices include, without limitation, Random Access Memory (RAM), Read Only Memory (ROM), flash memory, Hard Disk Drives (HDDs), Solid-State Drives (SSDs), optical disk drives, caches, variations or combinations of one or more of the same, or any other suitable storage memory.

In some examples, the term "physical processor" generally refers to any type or form of hardware-implemented processing unit capable of interpreting and/or executing computer-readable instructions. In one example, a physical processor may access and/or modify one or more modules stored in the above-described memory device. Examples of physical processors include, without limitation, microprocessors, microcontrollers, Central Processing Units (CPUs), Field-Programmable Gate Arrays (FPGAs) that implement softcore processors, Application-Specific Integrated Circuits (ASICs), portions of one or more of the same, variations or combinations of one or more of the same, or any other suitable physical processor.

Although illustrated as separate elements, the modules described and/or illustrated herein may represent portions of a single module or application. In addition, in certain embodiments one or more of these modules may represent one or more software applications or programs that, when executed by a computing device, may cause the computing device to perform one or more tasks. For example, one or more of the modules described and/or illustrated herein may represent modules stored and configured to run on one or more of the computing devices or systems described and/or illustrated herein. One or more of these modules may also represent all or portions of one or more special-purpose computers configured to perform one or more tasks.

In addition, one or more of the modules described herein may transform data, physical devices, and/or representations of physical devices from one form to another. For example, one or more of the modules recited herein may receive current elevation and/or sensor data to be transformed, transform the data to desired positions for each of a number of actuators, and use the result of the transformation to operate the actuators to reduce surface error of a continuous antenna reflector. Additionally or alternatively, one or more of the modules recited herein may transform a processor, volatile memory, non-volatile memory, and/or any other portion of a physical computing device from one form to another by executing on the computing device, storing data on the computing device, and/or otherwise interacting with the computing device.

In some embodiments, the term "computer-readable medium" generally refers to any form of device, carrier, or medium capable of storing or carrying computer-readable instructions. Examples of computer-readable media include, without limitation, transmission-type media, such as carrier waves, and non-transitory-type media, such as magnetic-storage media (e.g., hard disk drives, tape drives, and floppy disks), optical-storage media (e.g., Compact Disks (CDs), Digital Video Disks (DVDs), and BLU-RAY disks), electronic-storage media (e.g., solid-state drives and flash media), and other distribution systems.

The process parameters and sequence of the steps described and/or illustrated herein are given by way of example only and can be varied as desired. For example, while the steps illustrated and/or described herein may be shown or discussed in a particular order, these steps do not necessarily need to be performed in the order illustrated or discussed. The various exemplary methods described and/or illustrated herein may also omit one or more of the steps described or illustrated herein or include additional steps in addition to those disclosed.

The preceding description has been provided to enable others skilled in the art to best utilize various aspects of the exemplary embodiments disclosed herein. This exemplary description is not intended to be exhaustive or to be limited to any precise form disclosed. Many modifications and variations are possible without departing from the spirit and scope of the present disclosure. The embodiments disclosed herein should be considered in all respects illustrative and not restrictive. Reference should be made to the appended claims and their equivalents in determining the scope of the present disclosure.

Unless otherwise noted, the terms "connected to" and "coupled to" (and their derivatives), as used in the specification and claims, are to be construed as permitting both direct and indirect (i.e., via other elements or components) connection. In addition, the terms "a" or "an," as used in the specification and claims, are to be construed as meaning "at least one of." Finally, for ease of use, the terms "including" and "having" (and their derivatives), as used in the specification and claims, are interchangeable with and have the same meaning as the word "comprising."

What is claimed is:

1. A method comprising:

determining, at each of a plurality of elevation angles of a continuous antenna reflector included in an antenna assembly, a surface error over a reflecting surface of the continuous antenna reflector, the antenna assembly comprising:

a sub-reflector that receives a wireless signal from the reflecting surface and reflects the wireless signal to a feed structure for processing; and a backing structure coupled to a back surface of the continuous antenna reflector opposite the reflecting surface, wherein the backing structure comprises a plurality of actuators distributed over, and coupled to, the back surface;

determining, at each of the plurality of elevation angles, a stroke position of each of the plurality of actuators to minimize the surface error over the reflecting surface;

storing the determined stroke position of each of the plurality of actuators at each of the plurality of elevation angles;

determining a current elevation angle of the continuous antenna reflector; and operating each of the plurality of actuators in a manner that reduces the surface error at the current elevation angle by setting a current stroke position of each of the plurality of actuators to the corresponding stroke position stored for the current elevation angle.

2. The method of claim 1, wherein each of the plurality of actuators comprises a linear actuator oriented substantially normal to a corresponding point on the back surface at which the linear actuator is coupled.

3. The method of claim 1, wherein the plurality of actuators are coupled together using a plurality of linear elements, wherein at least some of the plurality of linear elements comprise:

a first end connected to a first one of the plurality of actuators; and a second end connected to a second one of the plurality of actuators.

4. The method of claim 3, wherein:

each of the plurality of linear elements has a substantially same length; and the plurality of actuators and the plurality of linear elements form a plurality of substantially equilateral triangles.

5. The method of claim 1, wherein:

the plurality of actuators are arranged into a plurality of groups; and the plurality of actuators of each of the plurality of groups are positioned at a substantially same distance from a center of the back surface of the continuous antenna reflector.

6. The method of claim 5, wherein the plurality of actuators of each of the plurality of groups are positioned equidistant about a circumference at the substantially same distance from the center of the back surface.

7. The method of claim 1, wherein:

the method further comprises determining an influence function over the reflecting surface for each of the plurality of actuators, wherein the influence function for each of the plurality of actuators describes movement of the reflecting surface in response to operation of the corresponding actuator; and determining the stroke position for each of the plurality of actuators for each of the plurality of elevation angles is based on the influence functions.

8. The method of claim 1, wherein storing the determined stroke position for each of the plurality of actuators for each of the plurality of elevation angles comprises storing the determined stroke positions in one or more lookup tables relating each of the plurality of elevation angles to the determined stroke position for each of the plurality of actuators.

9. The method of claim 1, wherein:

determining a current physical state regarding the antenna assembly by measuring a current physical state of the continuous antenna reflector using at least one sensor; and operating each of the plurality of actuators comprises operating each of the plurality of actuators based on the current physical state of the continuous antenna reflector.

10. The method of claim 9, wherein:

the at least one sensor comprises a distance sensor that measures a current location of each of a plurality of positions on at least one of the reflecting surface or the back surface; and the current physical state of the continuous antenna reflector comprises the current location of each of the plurality of positions.

11. The method of claim 9, wherein:

the at least one sensor comprises a plurality of strain gauges coupled to at least one of the reflecting surface or the back surface, wherein each of the plurality of strain gauges measures a current strain experienced by the at least one of the reflecting surface or the back surface at a location of the strain gauge; and the current physical state of the continuous antenna reflector comprises the current strain measured by each of the plurality of strain gauges.

12. A communication element comprising:

an antenna assembly comprising:

a feed structure that receives and processes a wireless signal;

a continuous antenna reflector that receives the wireless signal at a reflecting surface that reflects the wireless signal;

a sub-reflector that receives the wireless signal from the reflecting surface of the continuous antenna reflector and reflects the wireless signal to the feed structure for processing; and a backing structure coupled to a back surface of the continuous antenna reflector opposite the reflecting surface, wherein the backing structure comprises a plurality of actuators distributed over, and coupled to, the back surface; and a control system that:

determines a surface error over the reflecting surface at each of a plurality of elevation angles of the continuous antenna reflector;

determines, at each of the plurality of elevation angles, a stroke position of each of the plurality of actuators to minimize the surface error over the reflecting surface;

stores the determined stroke position of each of the plurality of actuators at each of the plurality of elevation angles;

determines a current elevation angle of the continuous antenna reflector; and operates each of the plurality of actuators in a manner that reduces the surface error at the current elevation angle by setting a current stroke position of each of the plurality of actuators to the corresponding stroke position stored for the current elevation angle.

13. The communication element of claim 12, wherein the backing structure further comprises a plurality of linear elements, wherein at least some of the plurality of linear elements mechanically couple a first of the plurality of actuators to a second of the plurality of actuators.

14. The communication element of claim 12, wherein:

the communication element further comprises a memory storing data relating each of the plurality of elevation angles of the continuous antenna reflector to the stroke position for each of the plurality of actuators; and the control system operates the plurality of actuators by setting each of the plurality of actuators to the stroke position stored in the memory associated with the current elevation angle.

15. The communication element of claim 12, wherein:

the communication element further comprises at least one sensor that senses a current physical state of the continuous antenna reflector; and the control system operates sets each of the plurality of actuators to the corresponding stroke position based on the current physical state of the continuous antenna reflector.

16. The communication element of claim 15, wherein the at least one sensor comprises a distance sensor that measures a current location of each of a plurality of positions on at least one of the reflecting surface or the back surface.

17. The communication element of claim 15, wherein the at least one sensor comprises a plurality of strain gauges coupled to at least one of the reflecting surface or the back surface, wherein each of the plurality of strain gauges measures a current strain experienced by the at least one of the reflecting surface or the back surface at a location of the strain gauge.

18. A system comprising:

an antenna assembly comprising:

a feed structure that receives and processes a wireless signal;

a continuous antenna reflector that receives the wireless signal at a reflecting surface that reflects the wireless signal;

a sub-reflector that receives the wireless signal from the reflecting surface of the continuous antenna reflector and reflects the wireless signal to the feed structure for processing; and a backing structure coupled to a back surface of the continuous antenna reflector opposite the reflecting surface, wherein the backing structure comprises a plurality of actuators distributed over, and coupled to, the back surface;

at least one physical processor; and physical memory comprising computer-executable instructions that, when executed by the physical processor, cause the physical processor to:

determine a surface error over the reflecting surface at each of a plurality of elevation angles of the continuous antenna reflector;

determine, at each of the plurality of elevation angles, a stroke position of each of the plurality of actuators to minimize the surface error over the reflecting surface;

store the determined stroke position of each of the plurality of actuators at each of the plurality of elevation angles;

determine a current elevation angle of the continuous antenna reflector; and operate each of the plurality of actuators in a manner that reduces the surface error at the current elevation angle by setting a current stroke position of each of the plurality of actuators to the corresponding stroke position stored for the current elevation angle.

* * * * *